US008594540B2

(12) United States Patent
Hirota et al.

(10) Patent No.: US 8,594,540 B2
(45) Date of Patent: Nov. 26, 2013

(54) DEVELOPMENT DEVICE, PROCESS CARTRIDGE INCORPORATING SAME, AND IMAGE FORMING APPARATUS INCORPORATING SAME

(75) Inventors: Tetsuro Hirota, Kanagawa (JP); Hideki Kosugi, Kanagawa (JP); Yoshiko Ogawa, Tokyo (JP); Atsushi Kurokawa, Kanagawa (JP); Hideyasu Seki, Tokyo (JP); Masaaki Yamada, Tokyo (JP); Yuji Ishikura, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 363 days.

(21) Appl. No.: 13/007,104

(22) Filed: Jan. 14, 2011

(65) Prior Publication Data

US 2011/0182626 A1 Jul. 28, 2011

(30) Foreign Application Priority Data

Jan. 25, 2010 (JP) ..... 2010-013052
Jan. 25, 2010 (JP) ..... 2010-013182
Oct. 7, 2010 (JP) ..... 2010-227685

(51) Int. Cl.
*G03G 15/08* (2006.01)

(52) U.S. Cl.
USPC ..... 399/265; 399/266

(58) Field of Classification Search
USPC ..... 399/119, 120, 252, 258, 265, 266, 290, 399/291
See application file for complete search history.

(56) References Cited

U.S. PATENT DOCUMENTS 5,799,234 A 8/1998 Furuya et al.
6,708,014 B2 3/2004 Miyaguchi et al.
6,901,232 B2 * 5/2005 Sakuma et al. ..... 399/266
7,580,648 B2 * 8/2009 Shaw et al. ..... 399/55
2004/0037593 A1 2/2004 Sakuma et al.

(Continued)

FOREIGN PATENT DOCUMENTS

EP 0 414 455 A2 2/1991
JP 3-21967 1/1991

(Continued)

OTHER PUBLICATIONS

U.S. Appl. No. 12/879,390, filed Sep. 10, 2010, Masanori Horike et al.

(Continued)

*Primary Examiner* — Hoan Tran
(74) *Attorney, Agent, or Firm* — Oblon, Spivak, McClelland, Maier & Neustadt, L.L.P.

(57) ABSTRACT

A development device includes a toner carrier including first and second groups of electrodes, a toner supplier, and an electrical field generator. The electrical field generator includes a positive-phase pulse voltage generation circuit, a negative-phase pulse voltage generation circuit, a first DC power source for supplying a bias for setting a peak value of pulse voltages, a second DC power source to output a variable voltage having a polarity identical to a polarity of toner charge, a first diode having an anode connected to a lower potential side of the first DC power source and a cathode connected to an output terminal of the positive-phase pulse voltage generation circuit, and a second diode having an anode connected to the lower potential side of the first DC power source and a cathode connected to an output terminal of the negative-phase pulse voltage generation circuit.

19 Claims, 29 Drawing Sheets

(56) References Cited

U.S. PATENT DOCUMENTS

| | | | | |
|---|---|---|---|---|
| 2004/0037596 | A1 | 2/2004 | Nakamura et al. | |
| 2005/0025525 | A1 | 2/2005 | Horike et al. | |
| 2007/0242985 | A1 | 10/2007 | Aoki et al. | |
| 2009/0016781 | A1 | 1/2009 | Takahashi et al. | |
| 2009/0035025 | A1 | 2/2009 | Ishii et al. | |
| 2010/0150615 | A1* | 6/2010 | Nakagawa et al. | 399/265 |
| 2010/0214364 | A1 | 8/2010 | Hirota et al. | |

FOREIGN PATENT DOCUMENTS

| | | |
|---|---|---|
| JP | 3-100575 | 4/1991 |
| JP | 3-113474 | 5/1991 |
| JP | 9-269661 | 10/1997 |
| JP | 2003-15419 | 1/2003 |
| JP | 2007-133387 | 5/2007 |
| JP | 3996363 | 8/2007 |
| JP | 4139714 | 6/2008 |

OTHER PUBLICATIONS

Extended European Search Report issued on Apr. 15, 2011 in corresponding European Application No. 11 15 1926.

* cited by examiner

DELAY BY DELAY CIRCUIT

DEVELOPMENT DEVICE, PROCESS CARTRIDGE INCORPORATING SAME, AND IMAGE FORMING APPARATUS INCORPORATING SAME

CROSS-REFERENCE TO RELATED APPLICATIONS

This patent specification is based on and claims priority from Japanese Patent Application Nos. 2010-013182, filed on Jan. 25, 2010, 2010-013052, filed on Jan. 25, 2010, and 2010-227685 filed Oct. 7, 2010 in the Japan Patent Office, which are hereby incorporated by reference herein in their entirety.

This patent specification is related to U.S. patent application Ser. No. 12/879,390, which is hereby incorporated by reference in its entirety.

BACKGROUND OF THE INVENTION

1. Field of the Invention

The present invention generally relates to a development device used in an image forming apparatus such as a copier, a printer, a facsimile machine, or a multifunction machine capable of at least two of these functions, a process cartridge incorporating the development device, and an image forming apparatus incorporating the development device.

2. Description of the Background Art

In general, electrophotographic image forming apparatuses, such as copiers, printers, facsimile machines, or multifunction devices including at least two of those functions, etc., include a latent image carrier on which an electrostatic latent image is formed and a development device to develop the latent image with developer. The developer is either one-component developer consisting essentially of only toner or two-component developer consisting essentially of toner and carrier.

Differently from methods in which toner is attracted to a development roller or magnetic carrier particles, there are image forming apparatuses that employ a so-called hopping development method in which toner (i.e., toner particles) used in image development is caused to hop along a surface of a developer carrier.

For example, JP-2007-133387 discloses a development device using a toner-carrying member that is disposed facing a latent image carrier and includes multiple electrodes arranged at a predetermined pitch in the circumferential direction of the toner-carrying member. The multiple electrodes cause the toner to hop along the surface of the toner-carrying member. An identical A-phase repetitive pulse is applied to every other electrode among the multiple electrodes, positioned at even-numbered arrangement positions, and an identical B-phase phase repetitive pulse, separate from the A-phase repetitive pulse, is applied to the other electrodes, positioned at odd-numbered arrangement positions. With this configuration, an alternating electrical field is generated between any two adjacent electrodes that in turn generate an electrostatic force that causes the toner to hop between adjacent electrodes. The toner hopping along the surface of the toner-carrying member is attracted to an electrostatic latent image formed on the latent image carrier, thus developing it into a toner image.

SUMMARY OF THE INVENTION

In view of the foregoing, one illustrative embodiment of the present invention provides a development device that causes toner to hop along a surface of a toner carrier so as to develop an electrostatic latent image formed on a latent image carrier. The development device includes a developer container for containing toner, the toner carrier disposed facing the latent image carrier and including a first group of electrodes and a second group of electrodes that together form a capacitor, a toner supplier disposed in the developer container, to supply the toner to a surface of the toner carrier, and an electrical field generator to generate an electrical field for causing the toner to hop along the surface of the toner carrier.

The electrical field generator includes a positive-phase pulse voltage generation circuit to generate a positive-phase pulse voltage applied to the first group of electrodes, a negative-phase pulse voltage generation circuit connected in parallel to the positive-phase pulse voltage generation circuit, to generate a negative-phase pulse voltage applied to the second group of electrodes, a first DC power source that is floating from a ground voltage for supplying a bias thereto for setting a peak value of the positive-phase pulse voltage and the negative-phase pulse voltage, a second DC power source connected between a lower potential side of the first power source and the ground voltage, to output a variable level of voltage having a polarity identical to a polarity of a charge of the toner, a first diode having an anode connected to a lower potential side of the positive-phase pulse voltage generation circuit and a cathode connected to an output terminal of the positive-phase pulse voltage generation circuit, and a second diode having an anode connected to the lower potential side of the positive-phase pulse voltage generation circuit and a cathode connected to an output terminal of the negative-phase pulse voltage generation circuit. The positive-phase pulse voltage generation circuit includes a first switching element, a second switching element, and a first current regulating resistor serially connected between terminals of the first power source. The negative-phase pulse voltage generation circuit includes a third switching element, a fourth switching element, and a second current regulating resistor serially connected between the terminals of the first power source. The first group of electrodes is connected between the first and second switching elements of the positive-phase pulse voltage generation circuit, and the second group of electrodes is connected between the third and fourth switching elements of the negative-phase pulse voltage generation circuit, thus forming a bridge configuration.

When the positive-phase pulse voltage is applied to the first group of electrodes, the first and fourth switching elements are turned on, and, when the negative-phase pulse voltage is applied to the second group of electrodes, the second and third switching elements are turned on.

Another illustrative embodiment of the present invention provides a process cartridge that is removably installable in an image forming apparatus and includes the above-described development device and at least one of the latent image carrier, a charge device, and a cleaning device housed in a common casing.

Yet another illustrative embodiment of the present invention provides an image forming apparatus including the latent image carrier and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
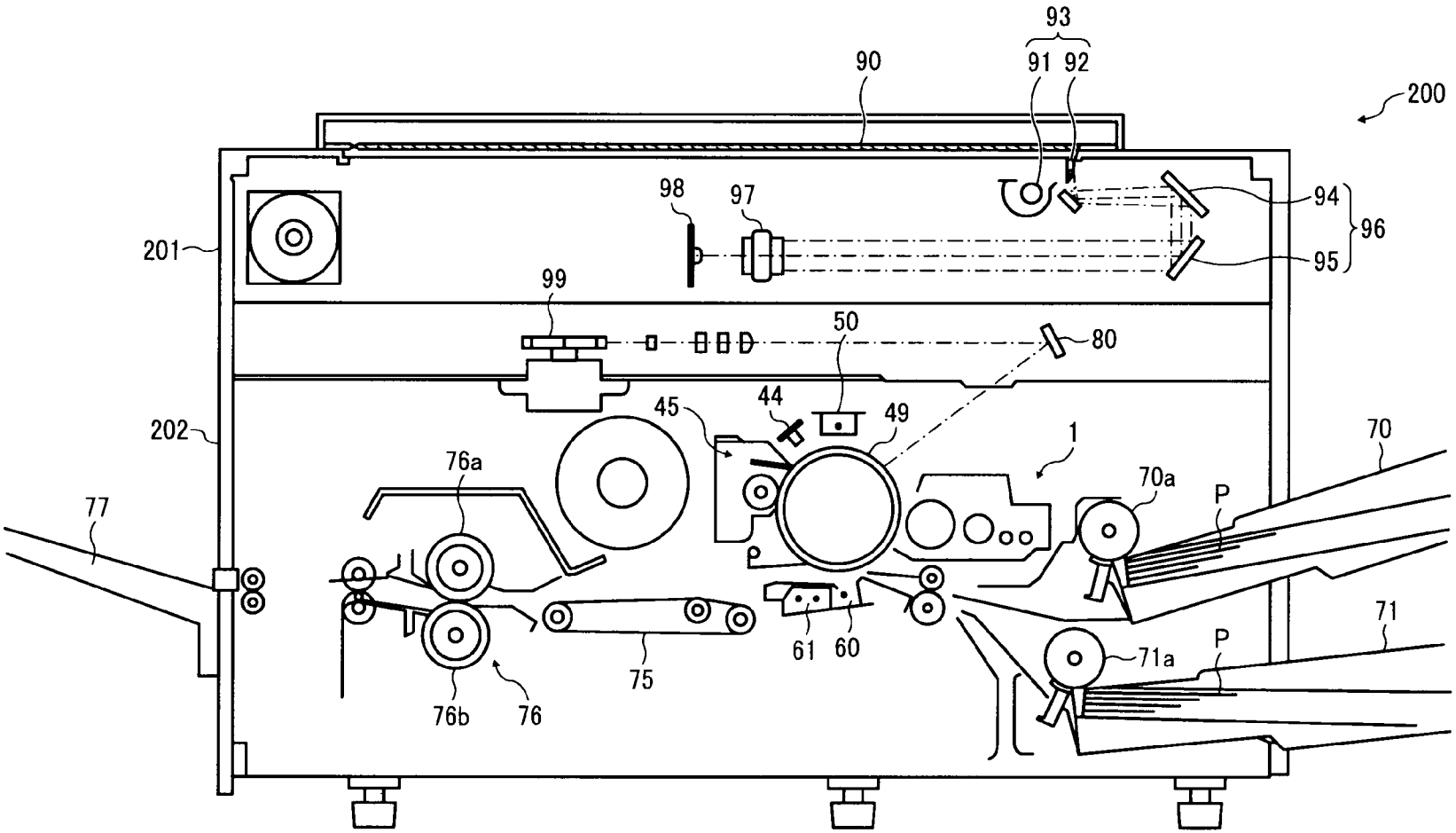
FIG. 1 is a schematic cross-sectional view of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to the present embodiment is described.

FIG. 1 is a schematic diagram illustrating a configuration of an image forming apparatus 200 according to the present embodiment.

The image forming apparatus 200 is a copier in the present embodiment. The image forming apparatus 200 includes an image forming unit 202 and a reading unit 201 positioned above the image forming unit 202. The reading unit 201 includes a contact glass 900 on which an original document is placed, a first optical scanning system 93 including a light source 91 and a mirror 92, a second optical scanning system 96 including mirrors 94 and 95, a lens 97, a mirror 80, an image reading element 98, and a polygon mirror 99. The image forming unit 202 includes a photoconductor 49, serving as an image carrier, that rotates clockwise in FIG. 1. A development device 1, a discharge lamp 44, a cleaning unit 45, a charging device 50, a transfer charger 60, and a separation charge 61 are provided around the photoconductor 49.

When a user places the original document on the contact glass 90 and presses a print start switch, the first optical system 93 and the second optical system 96 start moving and start reading image data of the original document. The image on the original document thus scanned is captured as image data by the image reading element 98 positioned on the back of the lens 97. The image data is digitalized, and image processing (e.g., color conversion, color calibration, and the like) thereof is performed. After the image processing, a laser diode (LD), not shown, is driven with a control signal. The polygon mirror 99 deflects a laser beam emitted from the laser diode, and then the laser beam scans a surface of the photoconductor 49 via the mirror 80. Before the above-described image scanning, the charging device 50 charges the surface of the photoconductor 49 uniformly, and an electrostatic latent image is formed thereon when the laser beam scans the surface of the photoconductor 49.

The development device 1 supplies developer (i.e., toner) to the latent image formed on the photoconductor 49, thus forming a toner image thereon. As the photoconductor 49 rotates, the toner image is transported to a transfer position facing the transfer charger 60. A sheet P (i.e., recording medium) is transported to the transfer position from a first feeder 70 provided with a first feed roller 70*a* or a second feeder 71 provided with a second feed roller 71*a*, timed to coincide with the arrival of the toner image on the photoconductor 49. The toner image is then transferred from the photoconductor 49 to the sheet P by corona discharging of the transfer charger 60.

Subsequently, the sheet P is separated from the surface of the photoconductor 49 by corona discharging of the separation charger 61 and transported by a conveyance belt 75 to a fixing device 76. The fixing device 76 includes a fixing roller 76*a* in which a heat source such as a halogen heater is provided and a pressure roller 76*b* pressing against the fixing roller 76*a*, thus forming a fixing nip therebetween. The sheet P is clamped in the fixing nip. In the fixing nip, the toner image is fixed on the sheet P with heat from the fixing roller 76*a* and pressure exerted by the pressure roller 76*b*, after which the sheet P is discharged onto a discharge tray 77 provided outside the image forming apparatus 200.

The cleaning unit 45 removes any toner that is not transferred to the sheet P but adheres to the surface of the photoconductor 49 after the photoconductor 49 passes the transfer position. Further, the discharge lamp 44 electrically discharges the surface of the photoconductor 49 thus cleaned in preparation for subsequent formation of a latent image.

In the present embodiment, the development device 1 and at least one of the photoconductor 49, the charging device 50, and the cleaning unit 45 are housed in a common unit casing and united as a process cartridge that is removably installable in a main body of the image forming apparatus 200. This configuration can facilitate maintenance work of the development device 1 and the like.

Figure 2:
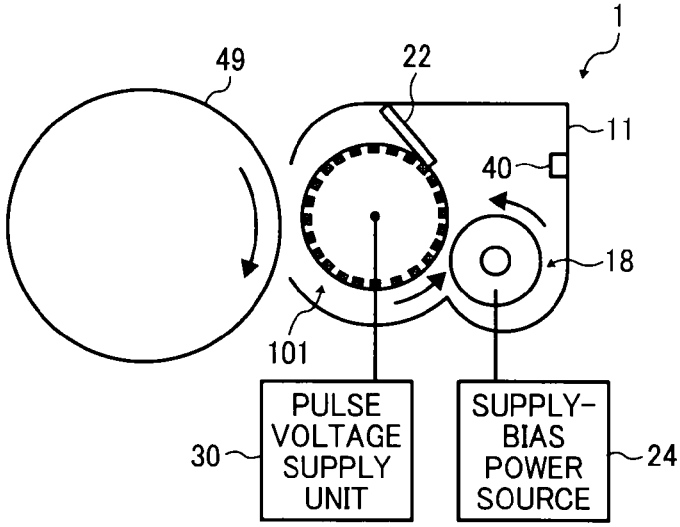
FIG. 2 is an end-on axial view that illustrates a photoconductor and a development device according to an illustrative embodiment.

FIG. 2 is a schematic end-on axial view of the photoconductor 49 and the development device 1 according to the present embodiment. The drum-shaped photoconductor 49 is rotated clockwise in FIG. 2 by a driving unit, not shown. The development device 1 is provided on the right of the photoconductor 49 in FIG. 2 and includes a toner-carrying roller 101 serving as a developer carrier.

The development device 1 further includes a toner supply roller 18 and a frictional blade 22. For example, the surface of the toner supply roller 18 is formed of sponge, and toner contained in a casing 11 (i.e., developer container) of the development device 1 is carried on the surface of the toner supply roller 18 while the toner supply roller 18 is rotated counterclockwise in FIG. 2 by a driving unit. In the configuration shown in FIG. 2, the toner supply roller 18 rotates in the direction opposite the direction in which the toner-carrying roller 101 rotates in a portion where the toner supply roller 18 faces the toner-carrying roller 101. Alternatively, the toner supply roller 18 may rotate in the direction identical to the direction in which the toner-carrying roller 101 rotates in the portion where the toner supply roller 18 faces the toner-carrying roller 101.

A supply-bias power source 24 applies a supply bias to a metal rotary shaft of a toner supply roller 18. Multiple electrodes, namely, electrodes for generating an A-phase A pulse voltage and electrodes for generating a B-phase pulse voltage, to be described below, are formed in the toner-carrying roller 101, and a pulse voltage supply unit or pulse voltage generation unit 30 applies repetitive pulse voltages to the multiple electrodes. A mean value of the pulse voltages has a polarity opposite the charge polarity of the toner and is a relatively large value. With this configuration, electrical fields that electrostatically transfer the toner from the toner supply roller 18 to the toner-carrying roller 101 are formed between the toner supply roller 18 and the toner-carrying roller 101.

The toner carried on the surface of the toner supply roller 18 is supplied to the toner-carrying roller 101 in a portion where the toner supply roller 18 is in contact with the toner-carrying roller 101. The amount of toner supplied to the toner-carrying roller 101 may be adjusted by changing the supply bias. It is to be noted that the supply bias can be a direct current (DC) voltage, an alternating current (AC) voltage, or a DC voltage overlapped with AC voltage.

As the toner-carrying roller 101 rotates counterclockwise in FIG. 2, the toner carried on the surface of the toner-carrying roller 101 moves generally in the circumferential direction thereof while hopping along the surface of the toner-carrying roller 101 due to effects to be described later. A first end of the frictional blade 22 is fixed, for example, to a casing 11, and a second end thereof that is not fixed (i.e., a free end) contacts the surface of the toner-carrying roller 101 downstream from the contact portion with the toner supply roller 18 and upstream from a development area facing the photoconductor 49 in the direction in which the toner-carrying roller 101 rotates. Thus, the toner moves counterclockwise in FIG. 2 while hopping along the surface of the toner-carrying roller 101 as the toner-carrying roller 101 rotates counterclockwise in FIG. 2. Then, entering the gap between the toner-carrying roller 101 and the frictional blade 22, the toner slidingly contacts the surface of the toner-carrying roller 101 and the surface of the frictional blade 22. Thus, the toner is electrically charged by friction.

As the toner-carrying roller 101 further rotates, the toner passes through the gap between the toner-carrying roller 101 and the frictional blade 22 and is transported to the development area while hopping along the surface of the toner-carrying roller 101. An opening is formed in the casing 11 of the development device 1, and the circumferential surface of the toner-carrying roller 101 is exposed partially. The exposed circumferential surface of the toner-carrying roller 101 is positioned across a gap from several ten micrometers to several hundred micrometers from the photoconductor 49. The portion where the toner-carrying roller 101 faces the photoconductor 49 is the development area of the image forming apparatus 200.

In the development area, development electrical fields are generated between the toner toner-carrying roller 101 and the photoconductor 49. The development electrical fields cause the toner to adhere to the electrostatic latent image formed on the surface of the photoconductor 49, thus developing it into a toner image. As the toner-carrying roller 101 rotates, the toner that is not used in image development is transported further and is supplied to the development area repeatedly while hopping along the surface of the toner-carrying roller 101.

It is to be noted that, instead of the toner-carrying roller 101, the frictional blade 22 may be in contact with the toner supply roller 18 so that the toner can be electrically charged by friction against the frictional blade 22 on the surface of the toner supply roller 18.

It is to be noted that reference number 40 in FIG. 2 represents a humidity detector that detects a humidity inside the development device 1. The image forming apparatus 200 may further includes a deterioration detector 41 (shown in FIG. 10) for detecting deterioration of the toner-carrying roller 101 over time based on the number of output sheets, the number of times the toner-carrying roller 101 has rotated, or the like.

Figure 3A:
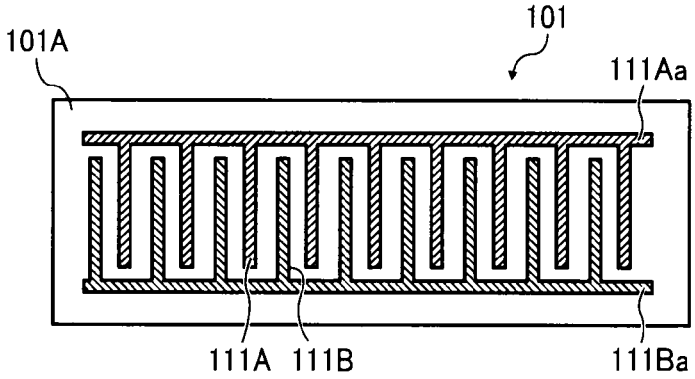
FIG. 3A is a schematic plan view in which a toner-carrying roller is developed into a planar structure.

Next, a configuration of the toner-carrying roller 101 is described below with reference to FIGS. 3A and 3B. FIG. 3A is a schematic plan view in which the toner-carrying roller 101 is developed into a planar structure, and FIG. 3B is a schematic cross-sectional view of the toner-carrying roller 101 developed planar, shown in FIG. 3A.

Figure 3B:
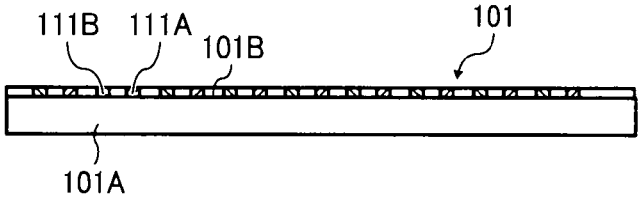
FIG. 3B is a schematic cross-sectional view of the toner-carrying roller developed planar, shown in FIG. 3A.
Figure 4:
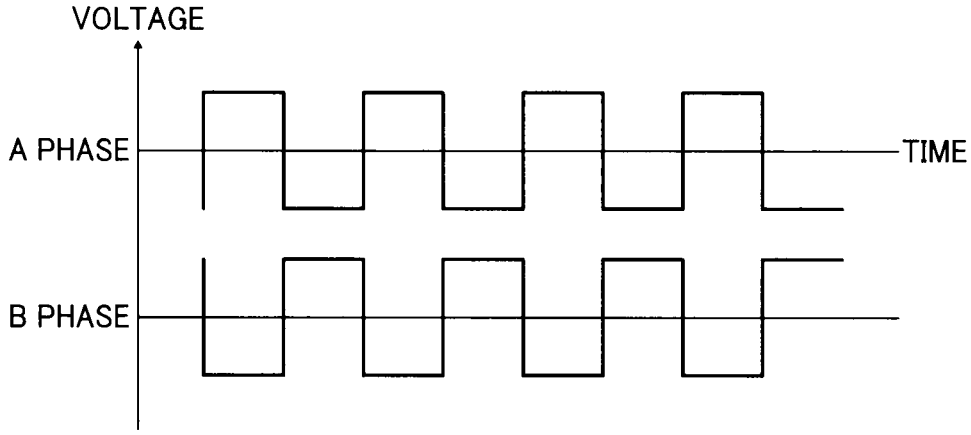
FIG. 4 is a graph that illustrates waveforms of A-phase pulse voltage and B-phase pulse voltage respectively applied to A-phase electrodes and B-phase electrodes.

In the configuration shown in FIGS. 3A and 3B, two different electrodes are arranged alternately on an electrically insulative base 101A of the toner-carrying roller 101. That is, two identical or similar electrodes are positioned across a single different electrode. Thus, the toner-carrying roller 101 includes electrodes for generating biphasic electrical fields. Two different pulse voltages whose phases are shifted 180 degrees from each other are applied to the two adjacent electrodes as shown in FIG. 4 so as to generate biphasic electrical fields in which attraction and repulsion are repeated in the two adjacent electrodes.

More specifically, the toner-carrying roller 101 includes multiple A-phase electrodes 111A for generating A-phase electrical fields and multiple B-phase electrodes 111B for generating B-phase electrical fields, provided on the insulative base 101A. Additionally, a protection layer 101B, that is, a surface layer, is provided on the A-phase electrodes 111A and the B-phase electrodes 111B (hereinafter also simply "the electrodes 111A and the electrodes 111B"). Each of the electrodes 111A and the electrodes 111B extends in parallel to each other in the axial direction of the toner-carrying roller 101, perpendicular to the circumferential direction thereof, in which toner is transported (hereinafter "toner conveyance direction"). The electrodes 111A and 111B are arranged at small pitch in the circumferential direction of the toner-carrying roller 101, thus forming a comb-like shape. The A-phase electrodes 111A (multiple first electrodes or a first group of electrodes) are connected to a biphasic output circuit including the pulse voltage supply unit 30 via a common bus line 111Aa on one side of the toner-carrying roller 101, and the B-phase electrodes 111B (multiple second electrode or a second group of electrodes) are connected to the biphasic output circuit via a common bus line 111Ba on the other side of the toner-carrying roller 101.

For example, the A-phase pulse voltage and the B-phase pulse voltage respectively applied to the A-phase electrodes 111A and the B-phase electrodes 111B have a frequency from about 0.3 kHz to 2.0 kHz and include a DC component as a bias. A peak value of the pulse voltages may be within a range of from 300 V to 600 V and be determined depending on the width of each electrode and the pitch between the electrodes 111A and 111B. In the case of the above-described biphasic electrical fields, switching of the direction of the electrical fields generated between two adjacent electrodes, a pair of electrodes 111A and 111B causes repulsion of toner to alternate with attraction of toner, and thus the toner moves back and forth between the electrodes 111A and 111B.

Next, the A-phase pulse voltage and B-phase pulse voltage respectively applied to the electrodes 111A and 111B are described in further detail below.

The pulse voltage supply unit 30 applies the A-phase pulse voltage and the B-phase pulse voltage to the A-phase electrodes 111A and the B-phase electrodes 111B, respectively. Rectangular waves are suitable for the A-phase pulse voltage and the B-phase pulse voltage. Additionally, in the present embodiment, the electrodes for forming toner clouds are biphasic and include the A-phase electrodes 111A and the B-phase electrode 111B, and the phases of the voltages applied thereto are different 180 degrees or $\pi$ from each other.

FIG. 4 is a graph that illustrates waveforms of the A-phase pulse voltage and the B-phase pulse voltage respectively applied to the A-phase electrodes 111A and the B-phase electrodes 111B.

In the present embodiment, the A-phase pulse voltage and the B-phase pulse voltage are rectangular waves and have an identical peak-to-peak voltage (Vpp), and their phases are shifted 180 degrees or $\pi$ from each other. Therefore, the difference between the A-phase pulse voltage and the B-phase pulse voltage constantly equals to the peak-to-peak voltage Vpp. The difference in voltage generates the electrical fields between the electrodes, and the toner is caused to hop along the surface of the toner-carrying roller 101 by the electrical fields generated outside the protection layer 101B (hereinafter "electrical fields for toner clouds").

As described above, the toner-carrying roller 101 includes the multiple electrodes extending in the direction perpendicular to the toner conveyance direction, arranged at the predetermined pitch. The voltages are applied to the electrodes to form the electrical fields whose direction alternate, and thus alternating attracting toner with repulsing toner. As the toner-carrying roller 101 rotates, the toner is transported and caused to form toner clouds simultaneously. With this configuration, the toner on the surface of the toner-carrying roller 101 can be transported reliably without being affected by the level of toner charge, and the image forming apparatus 200 can be reliable as a whole.

Descriptions will be given below of a toner-carrying roller 2 as a variation of the toner-carrying roller used in the development device 1 according to the present embodiment with reference to FIGS. 5A and 5B.

Figure 5A:
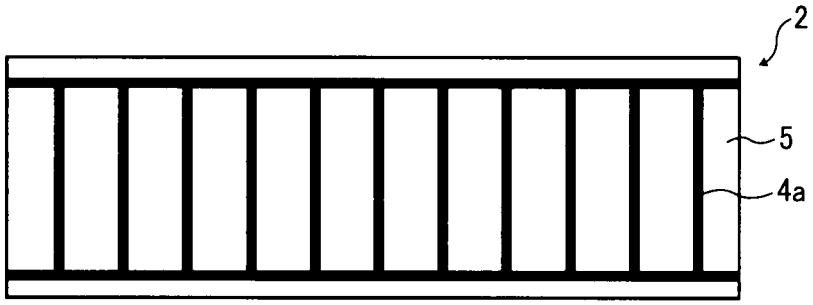
FIG. 5A is a schematic plan view of a toner-carrying roller according to another illustrative embodiment, developed into a planar structure.
Figure 5B:
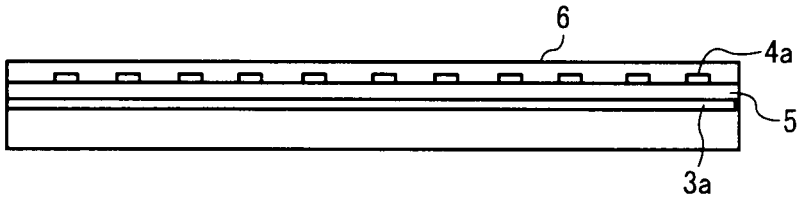
FIG. 5B is a schematic cross-sectional view of the toner-carrying roller developed planar, shown in FIG. 5A.

FIG. 5A is a schematic developed view in which the toner-carrying roller 2 is developed into a planar structure, and FIG. 5B is a schematic cross-sectional view of the developed toner-carrying roller 2 shown in FIG. 5A.

Figure 6:
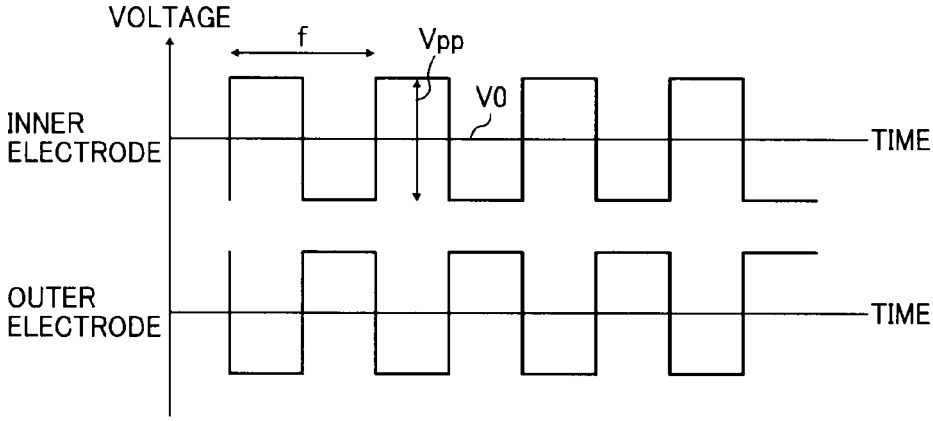
FIG. 6 is a graph that illustrates an inner bias voltage and an outer bias voltage respectively applied to an inner electrode and outer electrodes.

In the configuration shown in FIGS. 5A and 5B, two layers of electrodes, multiple outer electrodes and an inner electrode, are provided on a cylindrical base of the toner-carrying roller 2. The outer electrodes are identical or similar to each other, and an insulation layer is provided between the outer electrodes and the inner electrode serving as an electroconductive base. Two different pulse voltages whose phases are shifted 180 degrees from each other are applied to the outer electrodes and the inner electrodes as shown in FIG. 6 so as to cause attraction and repulsion of toner to alternate.

The toner-carrying roller 2 shown in FIGS. 5A and 5B is formed with a hollow cylinder that includes an inner electrode 3*a* as an innermost layer and multiple outer electrodes 4*a* positioned on the outer side of the inner electrode 3*a*. Thus, the toner-carrying roller 2 includes two groups of electrodes, namely, the multiple outer electrodes 4*a* and the portions of the inner electrode 3*a* that do not face the outer electrodes 4*a*. A voltage (i.e., an outer voltage) applied to the outer electrodes 4*a* is different from a voltage (i.e., an inner voltage) applied to the inner electrode 3*a*. An insulation layer 5 is provided between the inner electrode 3*a* and the outer electrodes 4*a* to insulate them from each other. Additionally, a surface layer 6 serving as a protective layer overlays the outer circumferential side of the outer electrodes 4*a*. Thus, the toner-carrying roller 2 has a multilayered structure including the inner electrode 3*a*, the insulation layer 5, the outer electrodes 4*a*, and the surface layer 6 in that order from inside.

The inner electrode 3*a* also serves as a base of the toner-carrying roller 2 and can be a roller formed of an electroconductive material. The inner electrode 3*a* can include SUS (Steel Use Stainless), aluminum, or the like. The inner electrode 3*a* can be manufactured by forming an electroconductive layer made of metal, such as aluminum or copper, on a surface of a resin roller. Examples of the material of the resin roller include polyacetal (POM) or polycarbonate (PC). The electroconductive layer can be manufactured through metal plating or vapor deposition. Alternatively, the metal layer may be bonded to the surface of the resin roller.

The outer circumferential side of the inner electrode 3*a* is covered with the insulation layer 5. The insulation layer 5 can be formed of polycarbonate, alkyd melamine, or the like. Through a spraying method or dipping method, the insulating layer 5 having a uniform thickness can be formed on the inner electrode 3*a*.

The outer electrodes 4*a* are provided on the insulation layer 5. The multiple outer electrodes 4*a* can be formed of metal such as aluminum, copper, silver, or the like. Various types of methods are available to form the outer electrodes 4*a*. For example, a metal layer can be formed on the insulation layer 5 through plating or vapor deposition, after which the metal layer can be etched by photoresist etching. Alternatively, electrodes arranged in a comb or ladder shape may be formed by causing an electroconductive paste to adhere to the insulation layer 5 through ink ejection or screen printing.

The outer circumferential side of the outer electrodes 4*a* and portions of the insulation layer 5 where the outer electrodes are not present are covered with the surface layer 6. Silicone, nylon (registered trademark), urethane, alkyd melamine, polycarbonate, or the like be used as the material of the outer layer 6. The surface layer 6 can be produced by splaying or dipping similarly to the insulation layer 5.

The electrical fields for causing the toner to hop are generated due to the effects of the inner electrode 3*a* and the outer electrodes 4*a*. More specifically, the electrical fields are formed by the effects of the outer electrodes 4*a* (tooth portions of the comb shape) and the portions where the outer electrodes 4*a* are not provided, that is, where the inner electrode 3*a* does not face the outer electrodes 4*a*. The electrical fields generated outside the surface layer 6 cause the toner to hop along the surface of the toner-carrying roller 2 and to form toner clouds. At that time, the toner flies reciprocally back and forth, that is, hops between portions of the surface of the toner-carrying 2 facing the inner electrode 3*a* across the insulation layer 5 and portions of the surface of the toner-carrying roller 2 facing the outer electrodes 4*a*.

Next, the inner bias voltage and the outer bias voltage (pulse voltages) respectively applied to the inner electrode 3*a* and the outer electrodes 4*a* are described in further detail below.

The pulse voltage supply unit 30 applies the inner bias voltage and the outer voltage to the inner electrode 3*a* and the outer electrodes 4*a* of the toner-carrying roller 2, respectively. In the present embodiment, the outer electrodes 4*a* extending in parallel to each other in the axial direction of the toner-carrying roller 2 are arranged at a predetermined pitch in the circumferential direction thereof (toner conveyance direction). Both end portions of the outer electrodes 4*a* are connected to a power receiving portion that is connected to the pulse voltage supply unit 30. Rectangular waves are suitable for the inner bias voltage and the outer bias voltage. Additionally, in the present embodiment, the inner electrode 3*a* and the outer electrodes 4*a* for causing toner clouds (i.e., flare of toner) have two different phases, and thus the present embodiment employs a biphasic configuration. The inner bias voltage and the outer bias voltage respectively applied to the inner electrode 3*a* and the outer electrodes 4*a* have a difference of $\pi$ (180 degrees) in phase from each other.

FIG. 6 is a graph that illustrates the inner bias voltage and the outer bias voltage respectively applied to the inner electrode 3*a* and the outer electrodes 4*a* as examples.

In the present embodiment, the inner bias voltage and the outer bias voltage are rectangular waves and have an identical peak-to-peak voltage (Vpp), and their phases are shifted 180 degrees or $\pi$ from each other. Therefore, the difference between the inner bias voltage and the outer bias voltage constantly equals to the peak-to-peak voltage Vpp. The difference in voltage generates the electrical fields between the electrodes, and the toner is caused to hop along the surface of the toner-carrying roller 2 by the electrical fields for toner clouds generated outside the protection layer 6.

For example, the pulse voltages applied to the inner electrode 3*a* and the outer electrodes 4*a* have a frequency from about 0.3 kHz to 2.0 kHz and include a DC component as a bias. A peak value of the pulse voltages may be within a range of from 300 V to 600 V and be determined depending on the width of each electrode and the pitch between the outer electrodes 4*a*. The electrical fields for causing the toner to hop are generated due to the effects of the inner electrode 3*a* and the outer electrodes 4*a*. More specifically, the electrical fields are formed by the effects of the outer electrodes 4*a* (tooth portions of the comb shape) and the portions of the inner electrode 3*a* where the outer electrodes 4*a* are not provided, that is, where the inner electrode 3*a* does not face the outer electrodes 4*a*. The electrical fields generated outside the surface layer 6 cause the toner to hop along the surface of the toner-carrying roller 2 and to form toner clouds. At that time, the toner flies reciprocally back and forth, that is, hops between portions of the surface of the toner-carrying 2 facing the inner electrode 3*a* across the insulation layer 5 and portions of the surface of the toner-carrying roller 2 facing the outer electrodes 4*a*. The toner-carrying roller 2 rotates in the toner conveyance direction.

Figure 7:
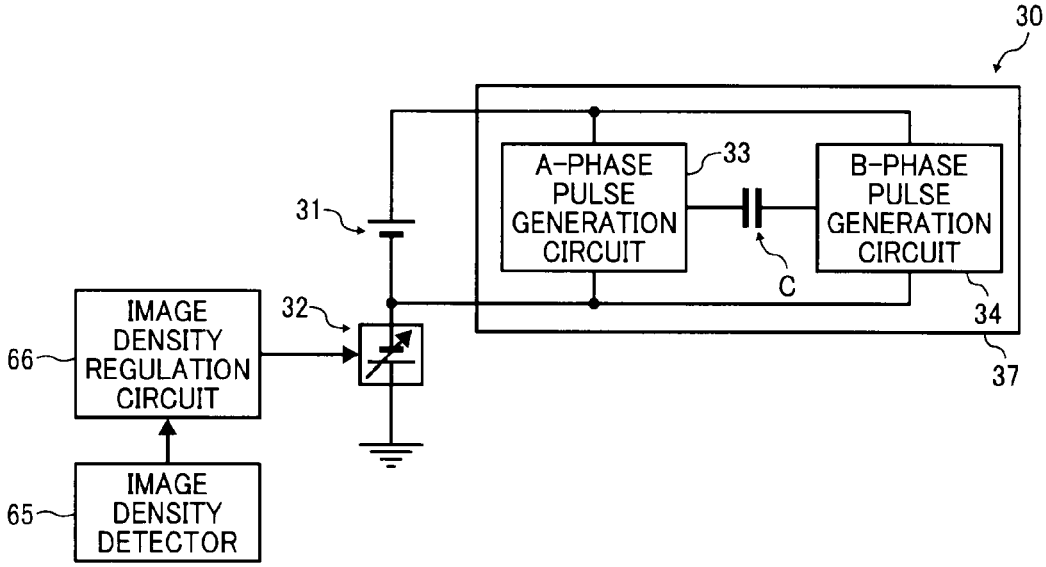
FIG. 7 illustrates schematic circuitry of a pulse voltage generation circuit for causing toner to form toner clouds when negatively charged toner is used.

FIG. 7 illustrates circuitry of the pulse voltage supply unit 30.

The pulse voltage supply unit 30 includes power sources 31 and 32, and a biphasic pulse output circuit 37. The power source 31 (first power source) is for outputting pulse for toner clouds and, a primary side and a secondary side thereof are separated (separation type). That is, the secondary side is floating against its ground terminal. The power source 32 (second power source) is for outputting a minus (negative) DC bias, and its primary side and secondary side are connected to a common ground terminal. The biphasic pulse output circuit 37 includes an A-phase pulse voltage generation circuit 33 for generating the A-phase pulses and a B-phase pulse generation circuit 34 for generating the B-phase pulses. Further, an image density detector 65 and an image density regulation circuit 66 are connected to the power source 32.

Figure 8:
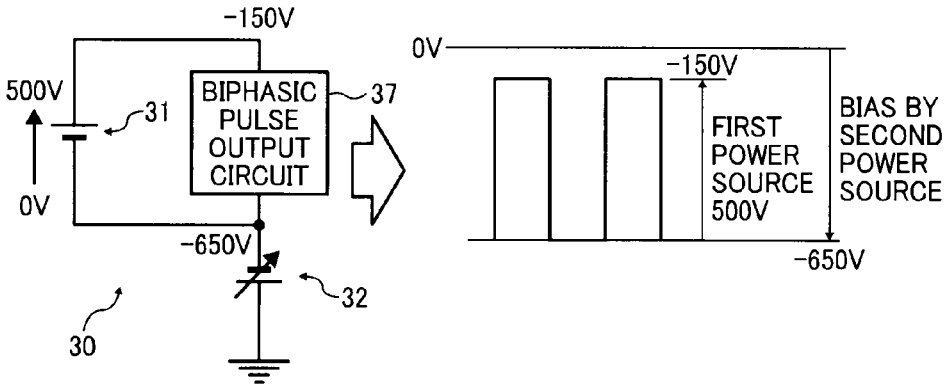
FIG. 8 illustrates circuitry of a pulse voltage generation circuit for causing toner to form toner clouds when negatively charged toner is used.

For example, when the output form the power source 31 is a voltage of 500 V, the high-level side is connected to the upper side of each of the A-phase pulse generation circuit 33 and the B-phase pulse generation circuit 34, and the low-level side is connected to the low-level side of each of the A-phase pulse generation circuit 33 and the B-phase pulse generation circuit 34. The low-level side is also connected to the minus high-level side of the power source 32. The development bias is a negative electrical potential when the toner having a negative polarity is used. When the power source 32 has a voltage of −650 V, the low-level side of the power source 31 has an electrical potential of −650 V. Accordingly, receiving the voltage of 500 V from the power source 31, the A-phase pulse generation circuit 33 and the B-phase pulse generation circuit 34 generate pulses having a peak value from −650 V to −150 V as shown in FIG. 8.

Herein, when image formation is conducted under a high-humidity environment, it is possible that liquid cross-linking force of toner increases, which increases the strength of adhesion between the toner and the surface of the toner-carrying roller 101 or the toner-carrying roller 2. Additionally, it is possible that toner charging efficiency decreases, thus reducing the charge amount of the toner. Accordingly, the electrostatic force generated by the alternating electric fields for causing toner clouds may be decreased. The above-described adverse effects inhibit the toner from hopping along the surface of the toner-carrying roller 101, causing a decrease in the amount of toner transferred to the latent image formed on the photoconductor 49. As a result, the image density is reduced.

On the other hand, when image formation is conducted under a low-humidity environment, it is possible that the liquid cross-linking force of toner decrease, thus reducing the strength of adhesion between the toner and the surface of the toner-carrying roller 101. It is also possible that the charge amount of the toner increases due to the increased toner charging efficiency, and accordingly the electrostatic force generated by the alternating electric fields for toner clouds may increase. As a result, it is possible that the toner on the surface of the toner-carrying roller 101 hops excessively high and the amount of toner adhering to the latent image formed on photoconductor 49 increases, thus increasing the image density.

Thus, in the development devices that employ the hopping development method, the density of the image formed on the photoconductor 49 tends to fluctuate due to changes in the environment in which image formation is conducted.

In view of the foregoing, in the present embodiment, the pulse voltage supply unit 30 employs, as the power source 32, a DC power source capable of changing the output level, the image density detector 65 for detecting the image density of a test pattern developed on the photoconductor 49, and the image density regulation circuit 66 for determining whether the detected image density satisfies a reference density. When the detected image density is lower than the reference density, the image density regulation circuit 66 raises the DC output level of the power source 32 in a minus direction to increase the development bias relative to the potential of the latent image, thereby making the image intensity uniform. When the detected image density is higher than the reference density, the image density regulation circuit 66 lowers the DC output level of the power source 32 in the minus direction to reduce the development bias relative to the potential of the latent image, thereby making the image intensity uniform.

Figure 9:
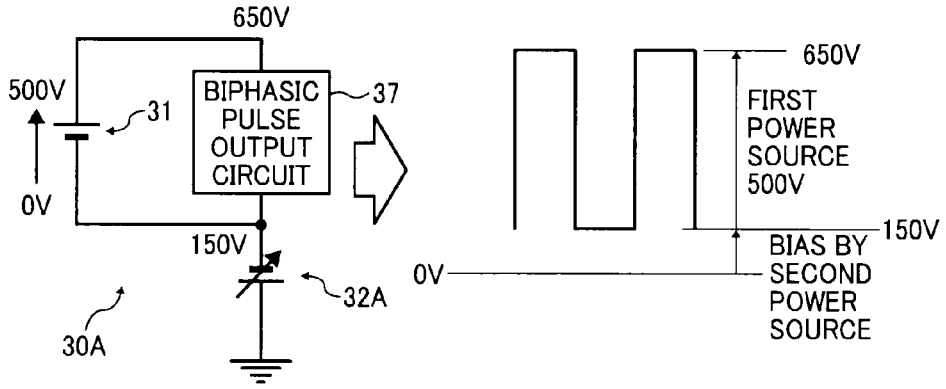
FIG. 9 illustrates a configuration of a pulse voltage supply unit (pulse voltage generation unit) and waveform of pulse voltage when positively charge toner is used.

FIG. 9 illustrates a configuration of a pulse voltage supply unit 30A and waveform of a pulse voltage generated by it when positively charged toner is used differently from the description above regarding the pulse voltage supply unit 30 shown in FIG. 7 for the negatively charged toner.

The pulse voltage supply unit 30A includes power sources 31 and 32A, and a biphasic pulse output circuit 37. The first power source 31 outputs pulse voltages for forming toner clouds, and a primary side and a secondary side thereof are separated (separation type). That is, the secondary side is floating against its ground terminal. The power source 32A is for outputting a plus DC bias differently from the power source 32 shown in FIG. 7, and its primary side and secondary side are connected to a common ground terminal.

For example, when the output form the first power source 31 is a voltage of 500 V, the high-level side is connected to the upper side of each of the A-phase pulse generation circuit 33 and the B-phase pulse generation circuit 34 (shown in FIG. 7), and the low-level side is connected to the low-level side of each of the A-phase pulse generation circuit 33 and the B-phase pulse generation circuit 34. The low-level side is also connected to the negative high side of the power source 32A. The development bias is a positive electrical potential relative to the electrical potential of the latent image when the toner having a positive polarity is used. Accordingly, when the power source 32A has a voltage of 150 V, the low-level side of the first power source 31 has an electrical potential of 150 V. Accordingly, receiving the voltage of 500 V from the first power source 31, the A-phase pulse generation circuit 33 and the B-phase pulse generation circuit 34 generate pulses having a peak value from 650 V to 150 V as shown in FIG. 8 for causing the toner to form toner clouds.

Figure 10:
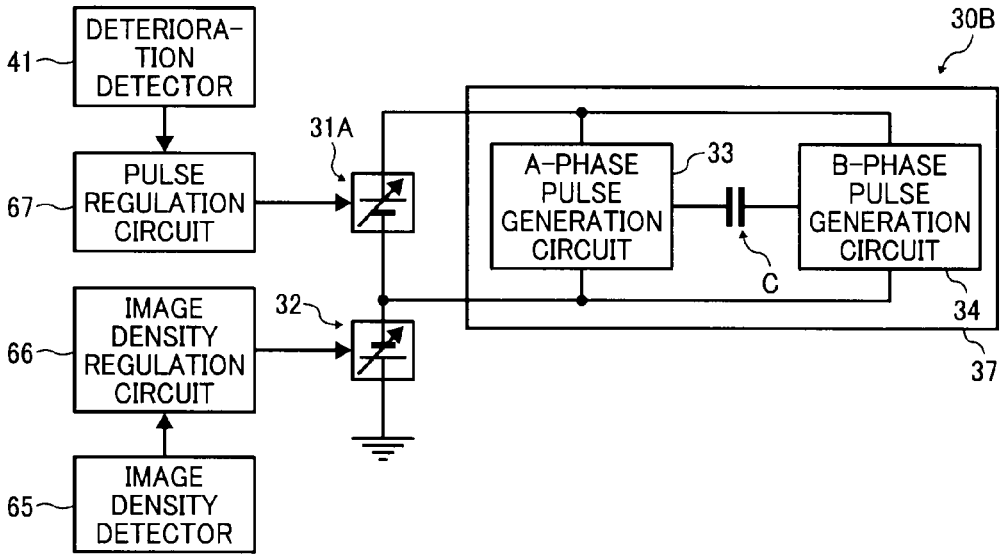
FIG. 10 illustrates control of first and second power sources in the schematic circuitry of the pulse voltage generation circuit when negatively charged toner is used.

FIG. 10 illustrates a pulse voltage supply unit 30B including a power source 31A (first power source) capable of changing the output level instead of the power source 31 shown in FIG. 7 for controlling the peak value of the pulses for toner clouds.

The pulse voltage supply unit 30B can change the output level of the power source 31A and output pulses for toner clouds in accordance with the changed level. When the output level of the power source 32 is fixed, the high value of the pulses for toner clouds can be varied with the low potential side thereof fixed. For example, the deterioration detector 41 detects the deterioration of the toner-carrying roller 101 over time by detecting the quantity of sheets on which images are formed. A pulse regulation circuit 67 lowers the output level of the power source 31A based on the detection by the deterioration detector 41, thereby reducing the peak-value of the pulses for toner clouds. Alternatively, the pulse regulation circuit 67 may adjust the output level of the power source 31A based on the humidity detected by the humidity detector 40. By regulating the amount of toner clouds, the image density can be regulated against the deterioration of the toner-carrying roller 101 or changes in the humidity. Accordingly, high quality images and reliable image development can be attained.

The humidity detector 40 (shown in FIG. 2), the deterioration detector 41, the image density detector 65, the image density regulation circuit 66, and the pulse regulation circuit 67 are operatively connected to a controller of the image forming apparatus 200. The controller includes CPU and associated memory units.

Figure 11:
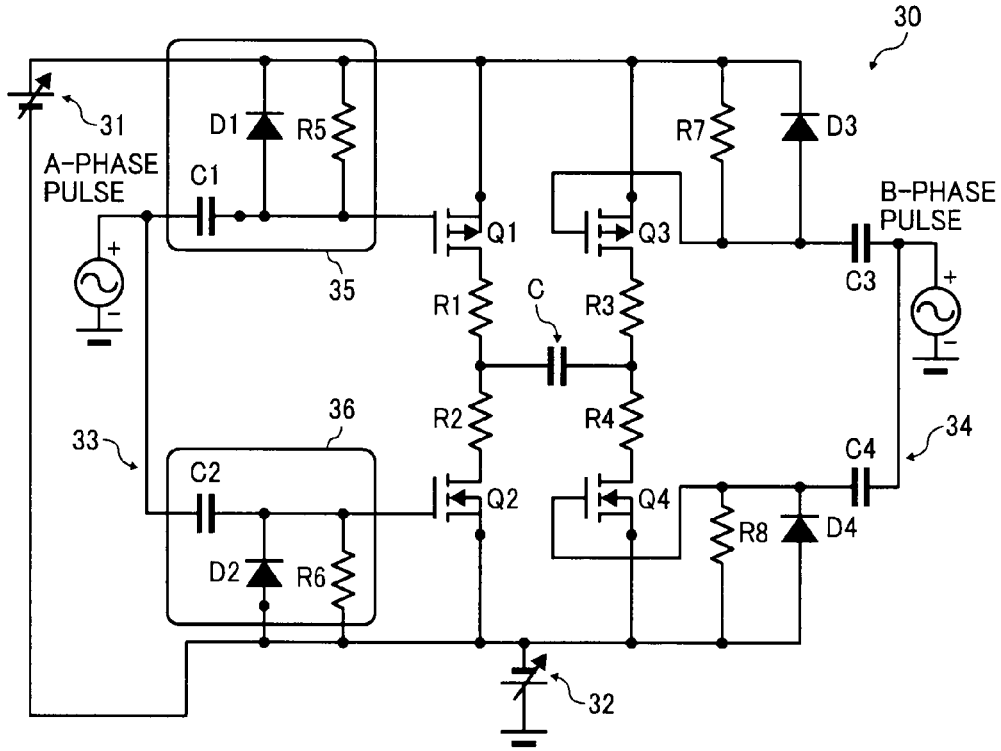
FIG. 11 illustrates circuitry of a pulse voltage generation circuit to which voltage for generating the pulse voltage for toner clouds and a bias voltage are applied.

FIG. 11 illustrates a configuration of the pulse voltage supply unit 30 shown in FIG. 7 in further detail.

In the pulse voltage supply unit 30 shown in FIG. 11, the A-phase pulse generation circuit 33 includes two switching elements Q1 and Q2, serving as first and second switching elements, formed of metal oxide semiconductor field effect transistors (MOSFETs) and current regulating resistors R1 and R2 (first current regulating resistors) serially connected between the terminals of the first power source or DC output power source 31. The B-phase pulse generation circuit 34 includes two switching elements Q3 and Q4, serving as third and fourth switching elements, formed of MOSFETs and current regulating resistors R3 and R4 (second current regulating resistors) serially connected between the terminals of the DC output power source 31 similarly to the A-phase pulse generation circuit 33. One of the first and second groups of electrodes of the toner-carrying roller 101, namely, the A-phase electrodes 111A and the B-phase electrodes 111B, is connected between the two switching elements Q1 and Q2 (i.e., between the current regulating resistors R1 and R2 in FIG. 11) of the A-phase pulse generation circuit 33, and the other group of electrodes of the toner-carrying roller 101 is connected between the two switching elements Q3 and Q4 (i.e., between current regulating resistors R3 and R4 in FIG. 11) of the B-phase pulse generation circuit 34. Thus, the first and second groups of electrodes together form a capacitor C, and a bridge configuration including the capacitor C is formed.

In the pulse voltage supply unit 30 having such a configuration, a normal-phase or positive-phase pulse (A-phase pulse in this embodiment) is applied to the electrodes by turning the switching elements Q1 and Q4 on, and a negative-phase or reversed-phase pulse (B-phase pulse in this embodiment) is applied by turning the switching elements Q2 and Q3 on. Accordingly, the toner repeatedly hops between the first group of electrodes and the second group of electrodes, thereby forming toner clouds on the surface of the toner-carrying roller 101.

It is to be noted that, in this embodiment, the pulse voltage supply unit 30 further includes a clamp circuit 35 that includes a capacitor C1, a diode D1, and a current regulating resistor R5. After a drive circuit for driving the MOSFETs (switching elements) generates a low voltage pulse of 15 V, a high value of the gate signal of the switching element Q1 (pulse of 15V) is clamped at the high-level side of the power source 31 by the clamp circuit 35. More specifically, when the voltage of the power source 31 is 500 V and the voltage of the power source 32 is −650 V, the gate signal of the switching element Q1 is a pulse voltage of −150 to −135 V, and the switching element Q1 is turned on while the gate signal is at a low level.

The pulse voltage supply unit 30 further includes a clamp circuit 36 that includes a capacitor C2, a diode D2, and a current regulating resistor R6. The low value of the gate signal of the switching element Q2 (pulses of 15V) is clamped at the low-level side of the power source 31 by the clamp circuit 36. More specifically, when the voltage of the power source 31 is 500 V and the voltage of the power source 32 is −650 V, the gate signal of the switching element Q2 has pulses of −650 to −635 V, and the switching element Q2 is turned on while the gate signal is at a high level.

In the B-phase pulse (reversed-phase) generation circuit 34, the switching elements Q3 and Q4 operate similarly with a phase delay of 180 degrees.

Figure 12:
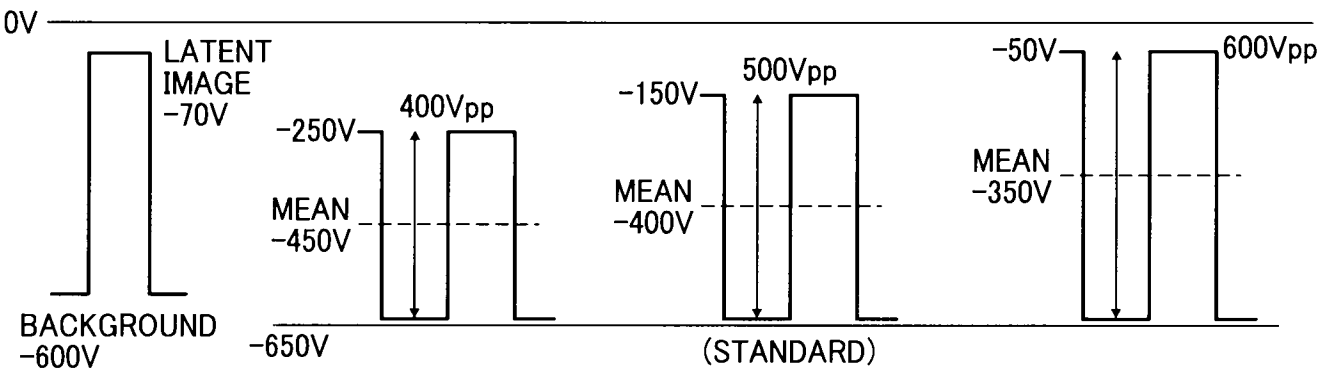
FIG. 12 illustrates waveforms of the pulse voltages when a lower peak value thereof is fixed at −650 V and a peak-to-peak voltage Vpp thereof is varied to 400 V, 500 V, and 600 V.

FIG. 12 illustrates waveforms of the pulse voltages when the lower peak value thereof is fixed at −650 V and the peak-to-peak voltage Vpp thereof is varied to 400 V, 500 V, and 600 V.

Figure 13A:
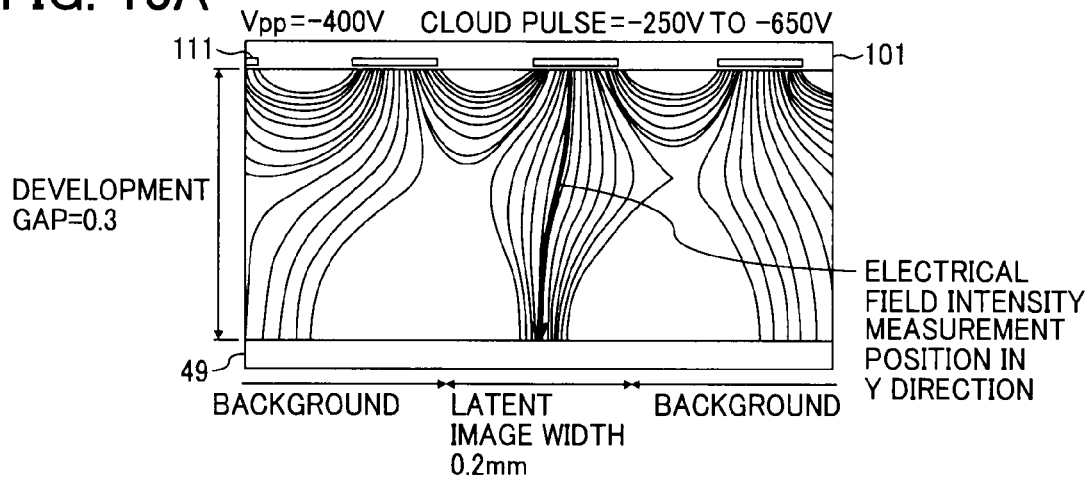
FIG. 13A is a diagram plotting lines of electrical force formed according to the intensity of electrical fields generated between the photoconductor and the toner-carrying roller based on simulation results in a case of pulse voltage of −250 V to −650 V, having a peak-to-peak voltage of 400 V.
Figure 13B:
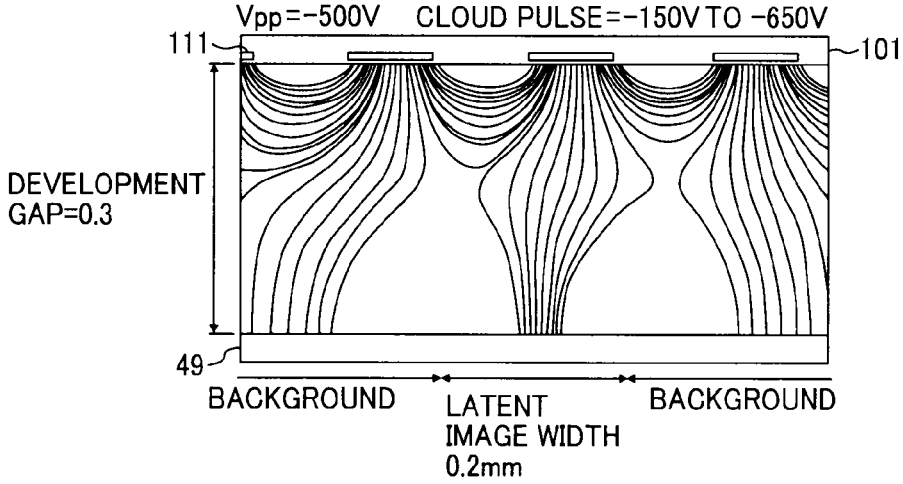
FIG. 13B is a diagram plotting lines of electrical force formed according to the intensity of electrical fields generated between the photoconductor and the toner-carrying roller based on simulation results in a case of pulse voltage of −150 V to −650 V, having a peak-to-peak voltage of 500 V.
Figure 13C:
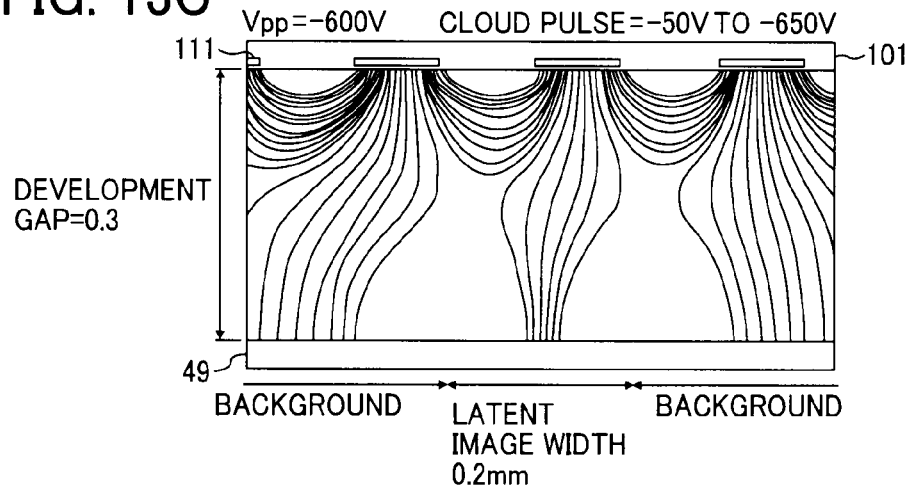
FIG. 13C is a diagram plotting lines of electrical force formed according to the intensity of electrical fields generated between the photoconductor and the toner-carrying roller based on simulation results in a case of pulse voltage of −50 V to −650 V, having a peak-to-peak voltage of 600 V.

FIG. 13A is a diagram plotting lines of electrical force formed according to the intensity of electrical fields generated between the photoconductor 49 and the toner-carrying roller 101 based on simulation results in a case of pulse voltage of −250 V to −650 V, having a peak-to-peak voltage of 400 V. FIG. 13B is a diagram plotting lines of electrical force formed according to the intensity of electrical fields generated between the photoconductor 49 and the toner-carrying roller 101 based on simulation results in a case of pulse voltage of −150 V to −650 V, having a peak-to-peak voltage of 500 V. FIG. 13C is a diagram plotting lines of electrical force formed according to the intensity of electrical fields generated between the photoconductor 49 and the toner-carrying roller 101 based on simulation results in a case of pulse voltage of −50 V to −650 V, having a peak-to-peak voltage of 600 V.

The simulation concerns the toner-carrying roller 101 including the A-phase pulse electrodes 111A and the B-phase pulse (reversed-phase) electrodes 111B each of which has a width of 100 μm, arranged alternately at intervals of 100 μm in the circumferential direction. Additionally, the width of the latent image, that is, a portion exposed according to the image data, on the photoconductor 49 positioned facing the toner-carrying roller 101 is 0.2 mm, and the other areas thereof are backgrounds (non-image area). The charging potential of the non-image area of the photoconductor 49 is −600 V, and the charging potential of the latent image is −70 V. A development gap, which is a gap between the surface of the toner-carrying roller 101 and the surface of the photoconductor 49, is 0.3 mm. It is to be noted that FIGS. 13A, 13B, and 13C illustrate only the lines of electric force that cross positions 20 μm above the surface of the electrodes of the toner-carrying roller 101 for forming toner clouds, and other lines of electric force that do not cross such positions are omitted.

Figure 14:
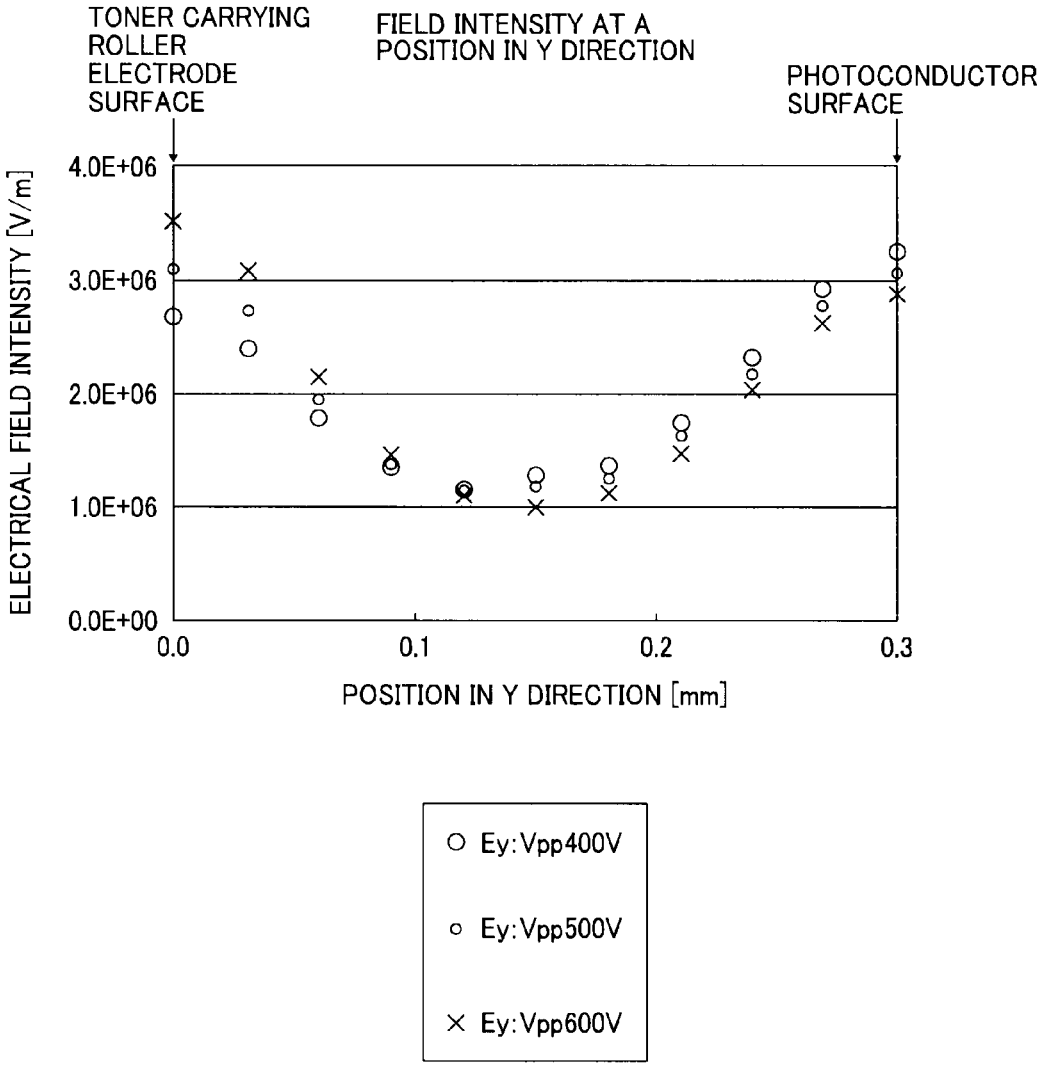
FIG. 14 is a graph illustrating the electrical field intensity in the Y direction in the development gap corresponding to FIGS. 13A, 13B, and 13C.

FIG. 14 is a graph illustrating the electrical field intensity in positions in the Y direction in the development gap corresponding to FIGS. 13A, 13B, and 13C. FIG. 14 illustrates electrical field intensity in the Y direction, connecting a central portion of the latent image and a central portion of the electrode to which a low potential is applied, the potential difference between which is largest.

As illustrated in FIG. 14, when the peak-to-peak voltage of the pulse voltage is changed to 400 V, 500 V, and 600 V while its lower peak value is constant (−650 V), in a region adjacent to the surfaces of the electrodes (i.e., the surface of the toner-carrying roller 101), the electrical field intensity is stronger when the peak value of the pulse voltage is larger than when the peak value is smaller. By contrast, in a region adjacent to the surface of the photoconductor 49, the electrical field intensity is weaker when the peak value of the pulse voltage is larger than when the peak value is smaller. As a result, the image intensity may be uniform as development results. Therefore, in order to maintain a uniform image density regardless of changes in the peak value of the pulse voltages for toner clouds, it is effective to control the voltage for repelling toner (lower peak of the pulse), applied to the electrodes for toner clouds. The voltage for repelling toner contributes to hopping behavior of toner significantly.

Figure 15:
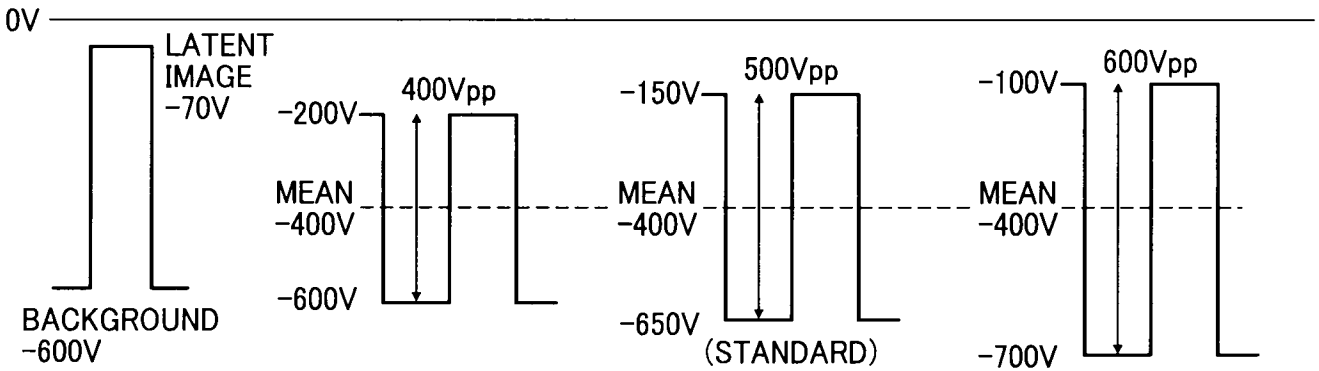
FIG. 15 illustrates waveforms of the pulse voltages when the mean value thereof is fixed (−400 V) and the peak-to-peak voltage Vpp thereof is varied to 400 V (pulse voltage of −200 to −600 V), 500 V (pulse voltage of −150 V to 650 V), and 600 V (pulse voltage of −100 V to −700 V)

FIG. 15 illustrates waveforms of the pulse voltages when the mean value thereof is fixed (−400 V) and the peak-to-peak voltage Vpp thereof is varied to 400 V (pulse voltage of −200 to −600 V), 500 V (pulse voltage of −150 V to 650 V), and 600 V (pulse voltage of −100 V to −700 V).

Figure 16:
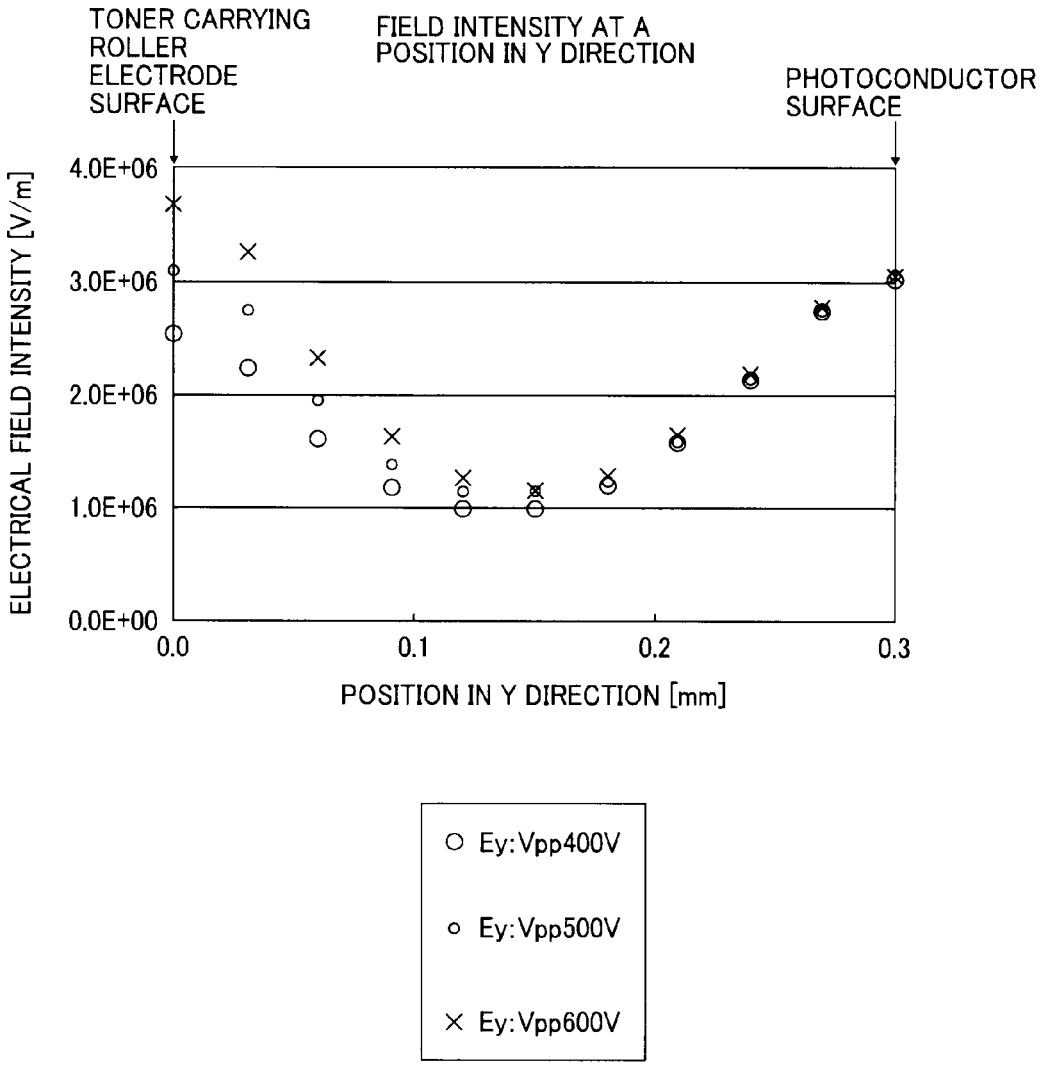
FIG. 16 is a graph that illustrates the electrical field intensity in positions in the Y direction in the development gap of the waveforms shown in FIG. 15.

FIG. 16 is a graph illustrating the electrical field intensity in positions in the Y direction in the development gap of the waveforms shown in FIG. 15.

As illustrated in FIG. 16, when the mean value of the pulse voltage is kept constant, in the region adjacent to the surfaces of the electrodes (i.e., the surface of the toner-carrying roller 101), the electrical field intensity is stronger when the peak value of the pulse voltage is larger than when the peak value is smaller. By contrast, in the region adjacent to the surface of the photoconductor 49, the electrical field intensity is similar even when the peak value is changed. As a result, the image intensity tends to be higher when the peak value is higher.

Figure 17A:
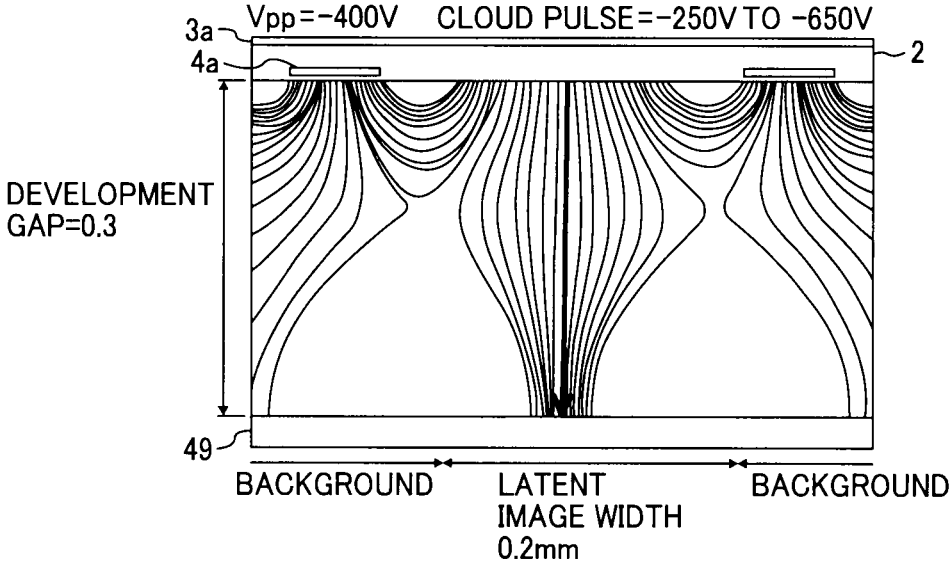
FIG. 17A is a diagram plotting lines of electrical force formed according to the intensity of electrical fields generated between the photoconductor and the toner-carrying roller based on simulation results in a case of pulse voltage of −250 V to −650 V, having a peak-to-peak voltage of 400 V.
Figure 17B:
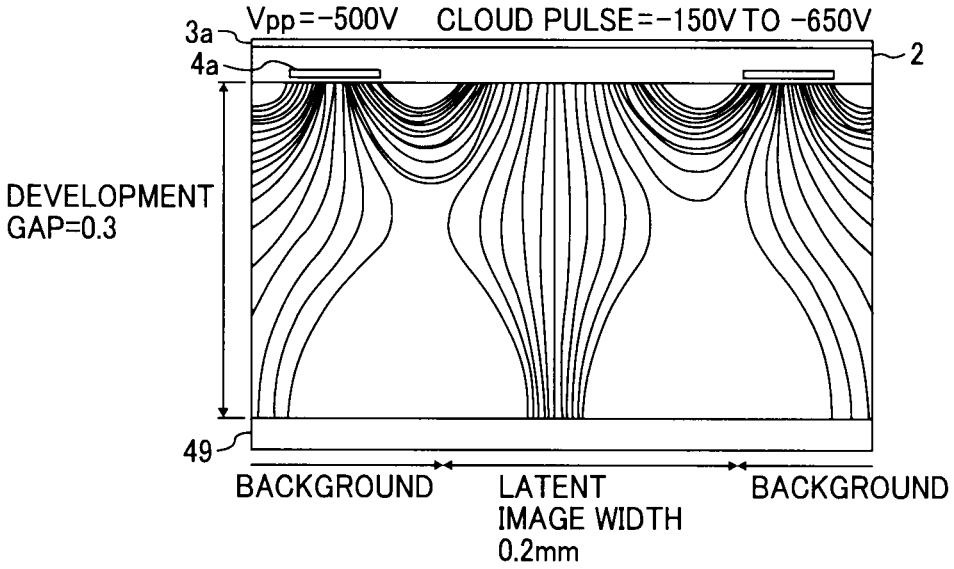
FIG. 17B is a diagram plotting lines of electrical force formed according to the intensity of electrical fields generated between the photoconductor and the toner-carrying roller based on simulation results in a case of pulse voltage of −150 V to −650 V, having a peak-to-peak voltage of 500 V.
Figure 17C:
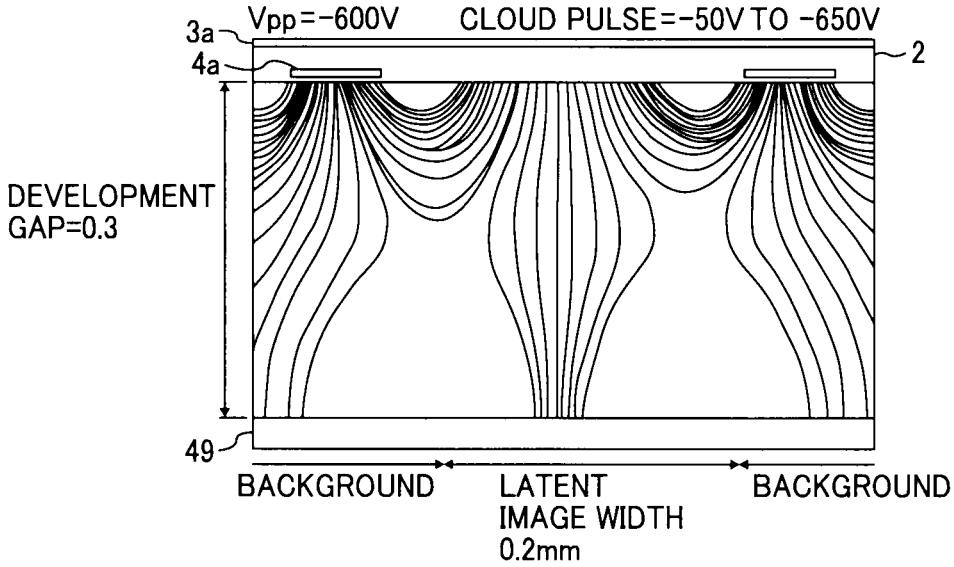
FIG. 17C is a diagram plotting lines of electrical force formed according to the intensity of electrical fields generated between the photoconductor and the toner-carrying roller based on simulation results in a case of pulse voltage of −50 V to −650 V, having a peak-to-peak voltage of 600 V.

FIG. 17A is a diagram plotting lines of electrical force formed according to the intensity of electrical fields generated between the photoconductor 49 and the toner-carrying roller 2 shown in FIGS. 5A and 5B based on simulation results in a case of pulse voltage of −250 V to −650 V, having a peak-to-peak voltage of 400 V. FIG. 17B is a diagram plotting lines of electrical force formed according to the intensity of electrical fields generated between the photoconductor 49 and the toner-carrying roller 2 based on simulation results in a case of pulse voltage of −150 V to −650 V, having a peak-to-peak voltage of 500 V. FIG. 17C is a diagram plotting lines of electrical force formed according to the intensity of electrical fields generated between the photoconductor 49 and the toner-carrying roller 2 based on simulation results in a case of pulse voltage of −50 V to −650 V, having a peak-to-peak voltage of 600 V.

In the simulation, the inner electrode 3*a* is a pipe made of, for example, aluminum so that the pipe can be electroconductive entirely. The insulation layer 5 having a thickness of 10 μm to 20 μm (16 μm in the simulation in FIGS. 17A, 17B, and 17C) is provided on the pipe (i.e., inner electrode 3*a*), the outer electrodes 4*a* each having a width of 100 μm are provided at intervals of 300 μm on the insulation layer 5, and the surface layer 6 of 15 μm is provided, as an insulative coat layer, as the outermost layer of the toner-carrying roller 2. The relative dielectric constant of each insulation layer in this examples is $\in r=3$.

In this simulation in which the pulse voltages are changed three levels of −250 V to −650 V in FIG. 17A, −150 V to −650 V in FIG. 17B, and −50 to −650 V in FIG. 17C, the results are similar to the results shown in FIG. 14 of the simulation using the toner-carrying roller 101 shown in FIGS. 3A and 3B. The image density can be kept substantially constant by controlling the electrical potential of the voltage for repelling toner (the lower peak of the pulse), applied to the electrodes for toner clouds.

When the humidity around the device is higher than a reference humidity, the peak value of the pulse voltages for toner clouds is raised to generate electric fields capable of causing the toner to hop well against the force of adhesion, such as the above-described liquid cross-linking force between the toner and the surface of the toner-carrying roller. For example, if the DC bias voltage of the power source 32 is −650 V and the peak value of the pulse voltage generated by the power source 31 is increased to 600 V from 500 V, which is for the standard humidity, the peak value of the pulse voltage output from the pulse generation circuit is −650 V to −50 V. Since the DC bias voltage of the power source 32 is constant, the potential of the toner repelling voltage applied to the electrodes for toner clouds (the lower peak of the pulse) has a constant potential of −650 V, thereby keeping the image density constant.

On the other hand, when the humidity is lower than the standard humidity, the force of adhesion of toner can decrease. When the jumping height of the toner above the toner-carrying roller increases, margin of contamination of backgrounds (toner scattering in the non-image area) of the toner-carrying roller is reduced. Therefore, the peak value of the pulse voltages for toner clouds should be reduced. For example, if the DC bias voltage of the power source 32 is −650 V and the peak value of the pulse voltage generated by the power source 31 is reduced to 400 V from 500 V, which is for the standard humidity, the peak value of the pulse voltage output from the pulse generation circuit is −650 V to −250 V. Since the DC bias voltage of the power source 32 is constant, the potential of the toner repelling voltage applied to the electrodes for toner clouds (the lower peak of the pulse) has a constant potential of −650 V, thereby keeping the image density constant.

Figure 18:
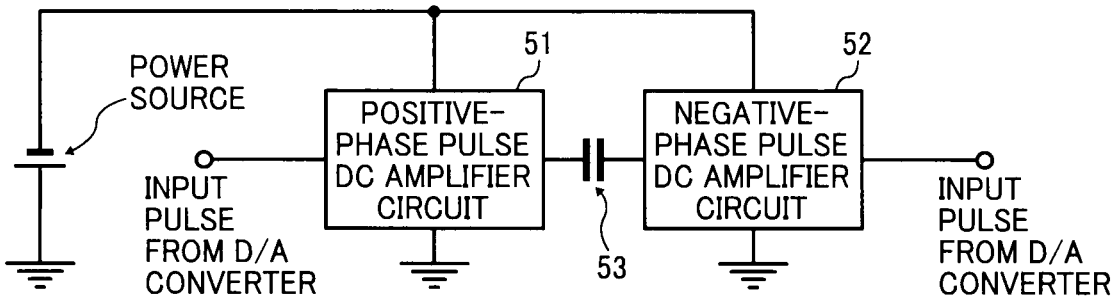
FIG. 18 schematically illustrates circuitry of a comparative pulse voltage supply unit.

FIG. 18 illustrates a schematic configuration of a comparative pulse voltage supply unit.

In this comparative example, since a signal including the pulse and the DC bias must be output as the signal applied to the electrodes for toner clouds, a pulse signal including the low DC voltage is generated from a D/A converter (not shown), and the comparative pulse voltage supply unit further includes two DC amplifier circuits each having a feedback circuit, that is, a positive pulse DC amplifier circuit 51 and a negative pulse DC amplifier circuit 51, so as to amplify the generated signal to a voltage about 300 V to 600 V. The amplified voltage is applied to both ends of a capacitor (capacity load) 53. However, this comparative example has a drawback in that the circuit cost increases and DC drift of the amplifier circuits due to changes in temperature is present. Moreover, fluctuations in the amplification factor due to the change in temperature with time may cause the pulse peak value as well as the DC bias voltage to fluctuate, thereby affecting cloud properties and degrading the image quality such as image density. Although other configurations such as a configuration in which a high-voltage pulse is generated by a transformer and a DC bias is added to it simultaneously may be adopted, the components becomes bulkier, the cost increases, and there is power loss. Thus, such configurations are not preferred.

By contrast, the pulse voltage supply unit 30 shown in FIGS. 7 and 11 according to the embodiments of the present invention employs, instead of the DC amplifier circuits, the switching circuits. Therefore, compared with such configurations using the DC amplifier circuits, the number of components can be reduced and the output level can be stable. Thus, compactness and higher reliability of the development device can be attained while the cost is reduced. Although adjustment of the DC component for regulating the development bias (the mean value of the pulse voltages) cannot be achieved with the switching circuit alone, it can be achieved with the configuration such as the pulse voltage supply unit 30 according to the present embodiment. Therefore, by using the pulse voltage supply unit 30 according to the present embodiment, the above-described inconveniences can be eliminated or reduced.

Figure 19:
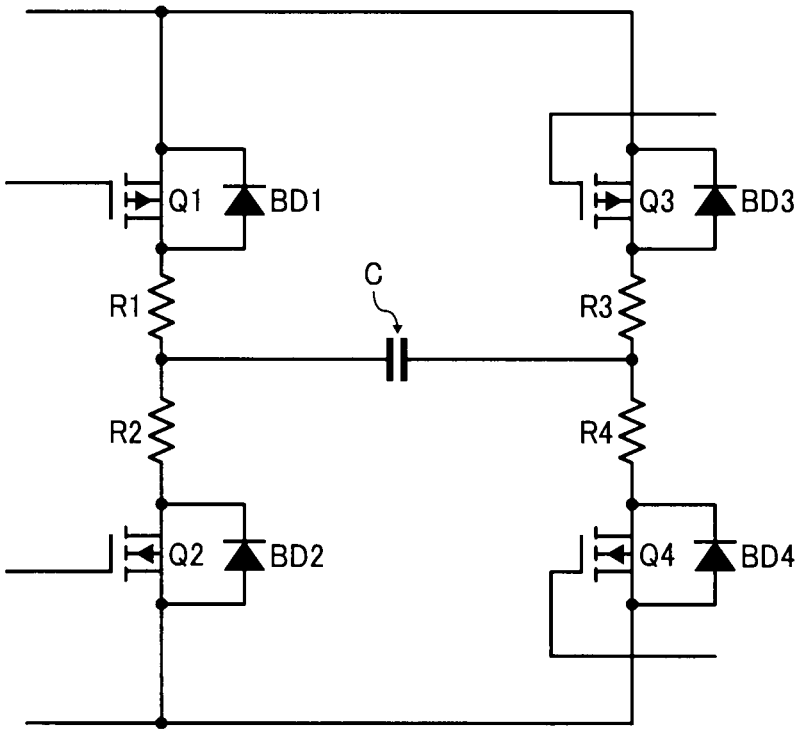
FIG. 19 illustrates circuitry of the pulse voltage supply unit shown in FIG. 11 partially, and body diodes (parasitic diodes) are provided for first, second, third, and fourth switching elements.

FIG. 19 illustrates circuitry of the pulse voltage supply unit 30 shown in FIG. 11 partially, and body diodes (parasitic diodes) BD1, BD2, BD3, and BD4 are provided for the switching elements Q1, Q2, Q3, and Q4, respectively.

Figure 20:
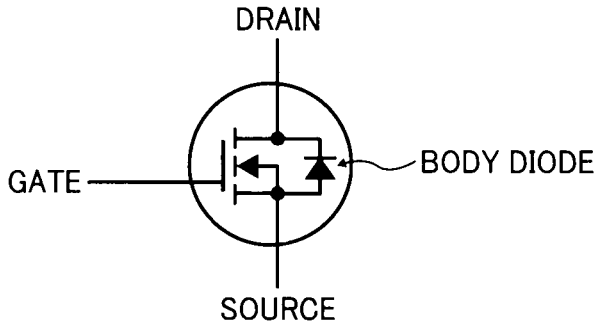
FIG. 20 illustrates an internal configuration of a power MOSFET used in an A-phase pulse voltage generation circuit and a B-phase pulse voltage generation circuit.

Descriptions are given below of an internal configuration of the power MOSFETs (switching elements) used in the A-phase pulse generation circuit 33 and the B-phase pulse generation circuit 34 with reference to FIG. 20.

Figure 21:
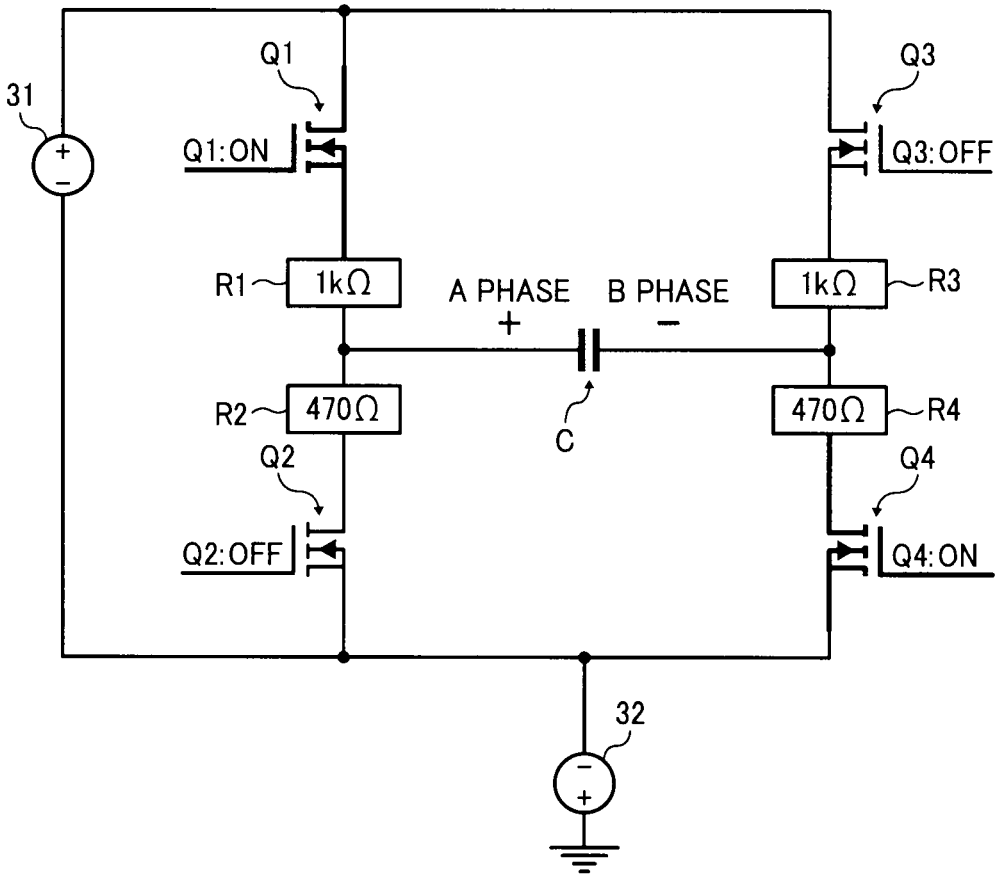
FIG. 21 illustrates circuitry of the pulse voltage supply unit shown in FIG. 11 concerning a circuit operation in time t1 and body diodes are omitted therein.

Although the body diode is often omitted in the circuit symbol of the power MOSFET as shown in FIG. 21, the body diode is actually included inside the element. Even when the power MOSFET is off, electrical current flows from the source to drain through the body diode. Thus, because the switching elements Q1, Q2, Q3, and Q4 include the body diodes BD1, BD2, BD3, and BD4, respectively, electrical current flows from the source to drain through the body diode BD1, BD2, BD3, or BD4 in each of the switching elements Q1, Q2, Q3, and Q4.

Operation of the switching elements of the pulse voltage supply unit 30 is described in further detail below in a case in which the output of the first power source 31 is +500 V and that of the second power source 32 is 0 V for ease of understanding.

Figure 22:
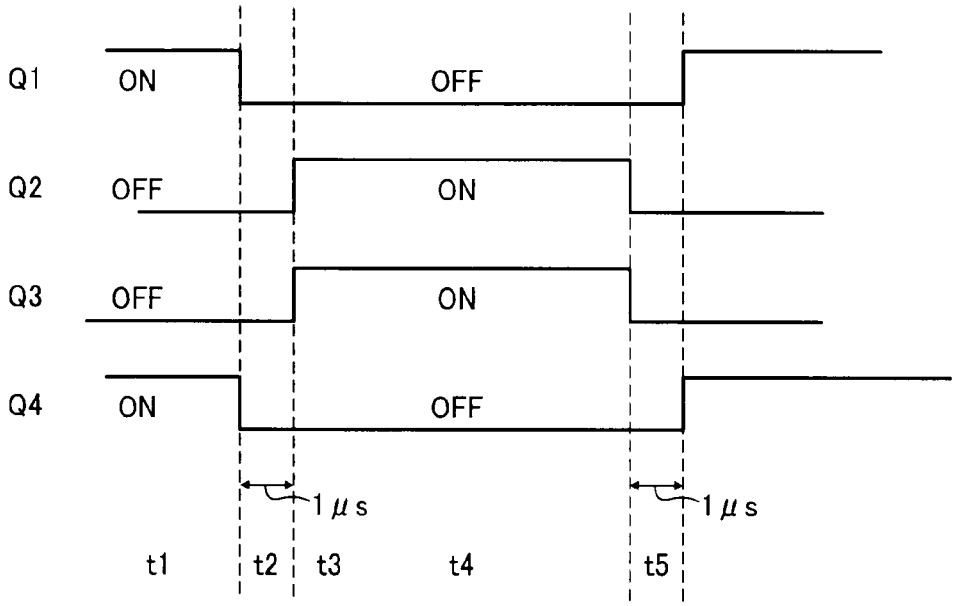
FIG. 22 illustrates on/off operational sequence of the first, second, third, and fourth switching elements.
Figure 23:
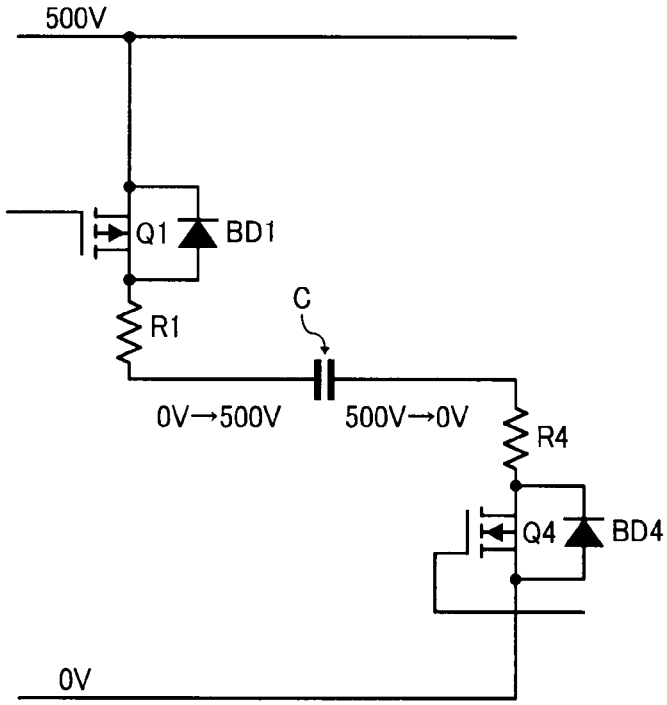
FIG. 23 illustrates the circuitry concerning the operation in time t1 in FIG. 22 partly.
Figure 38:
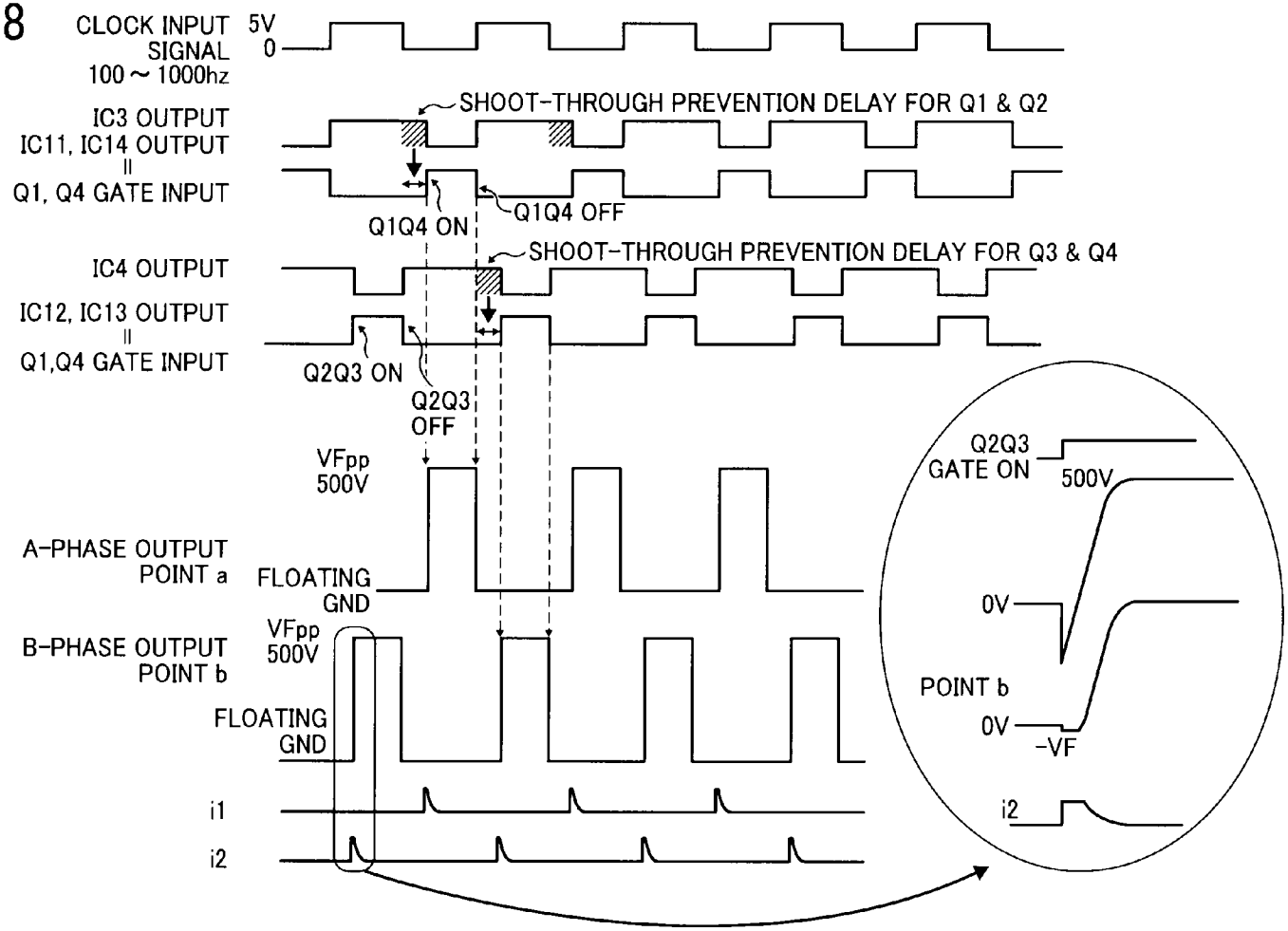
FIG. 38 illustrates on/off operational sequence of the first, second, third, and fourth switching elements.

FIGS. 22 and 38 illustrate on/off operational sequence of the switching elements Q1, Q2, Q3, and Q4. It is to be noted that FIG. 21 illustrates circuitry that concerns the circuit operation in period of time t1 in the operational sequence shown in FIG. 22, and FIG. 23 illustrates a part of the circuitry concerning the circuit operation in time t1 in FIG. 22.

By turning the switching elements Q1 and Q4 on, electrical current flows in a loop from the drain of the switching element Q1 to the current regulating resistor R1, the capacitor C, the current regulating resistor R4, and the switching element Q4 in that order. The capacitor C is charged with a time constant of $\tau=C\times(R1+R4)$.

In this circuitry, because the current regulating resistors R1 and R4 have an identical resistance of 100Ω to 300Ω (R1=R4=100Ω to 300Ω) and the capacitor C is 100 nF, the time constant is 2 μs to 6 μs. When the charge voltage is considered in view of the time constant, the charge voltage is 63.2% when the time constant is multiplied by one, 86.5% when the time constant is multiplied by two, 95% when the time constant is multiplied by three, and 98.2% when the time constant is multiplied by four. Therefore, after about 30 fifth times the time constant, the left end of the capacitor C is charged to approximately 500 V and the right side thereof is charged to approximately 0 V. Thus, the charge electrical current is substantially zero.

Figure 24:
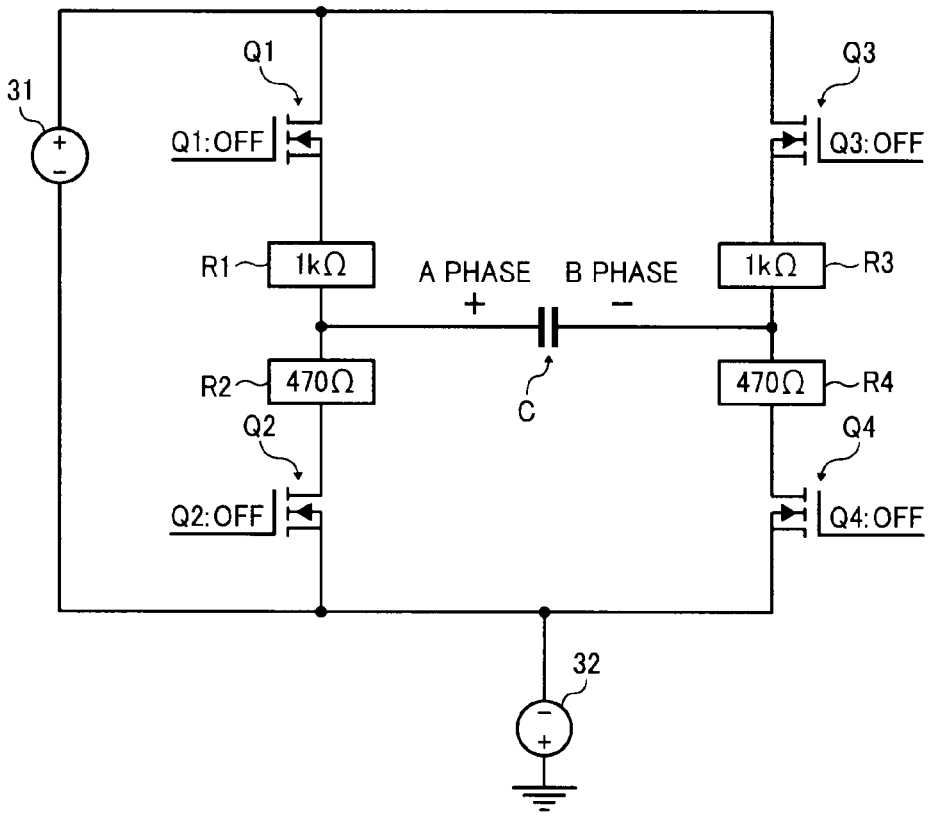
FIG. 24 illustrates circuitry that concerns the circuit operation in time t2 in the operational sequence shown in FIG. 22.
Figure 25:
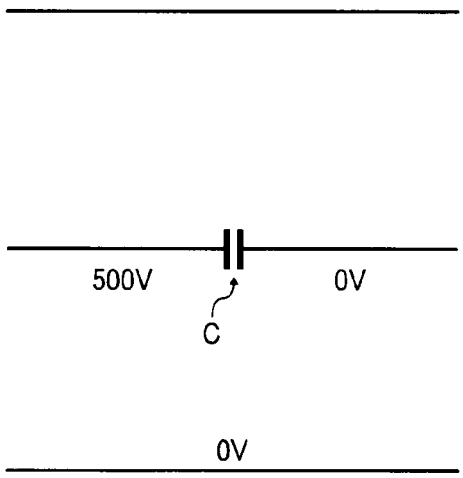
FIG. 25 illustrates a part of the circuitry concerning the circuit operation in time t2 in FIG. 22.

FIG. 24 illustrates circuitry that concerns the circuit operation in time t2 in the operational sequence shown in FIG. 22. FIG. 25 illustrates a part of the circuitry concerning the circuit operation in time t2 in FIG. 22.

In a configuration in which the switching element Q2 is designed to switch from an off-state to a on-state simultaneously when the switching element Q1 switches from a on-state to an off-state, if the switching element Q2 is turned on although the switching element Q1 is still on due to fluctuations in the operational timing, an electricity of 500 V/(R1+R2) flows from the switching element Q1 to the switching element Q2. This current is called "shoot-through current", which can cause various inconveniences such as damage to the switching element Q2, an increase in stress or load to the first power source 31 due to a large current, noises that might cause malfunction of the circuit, and the like.

To prevent such shoot-through current, the operational sequence includes a period during which all of the switching elements Q1, Q2, Q3, and Q4 are off (time t2 in FIG. 22), thereby preventing or reducing the inconveniences resulting from the shoot-through current. In the example shown in FIG. 22, the time t2 is 1 μs. Additionally, during the time t2, for example, 1 μs, during which all of the switching elements Q1, Q2, Q3, and Q4 are off, the charge is kept in the capacitor C because its electrical discharge route is not present.

Figure 26:
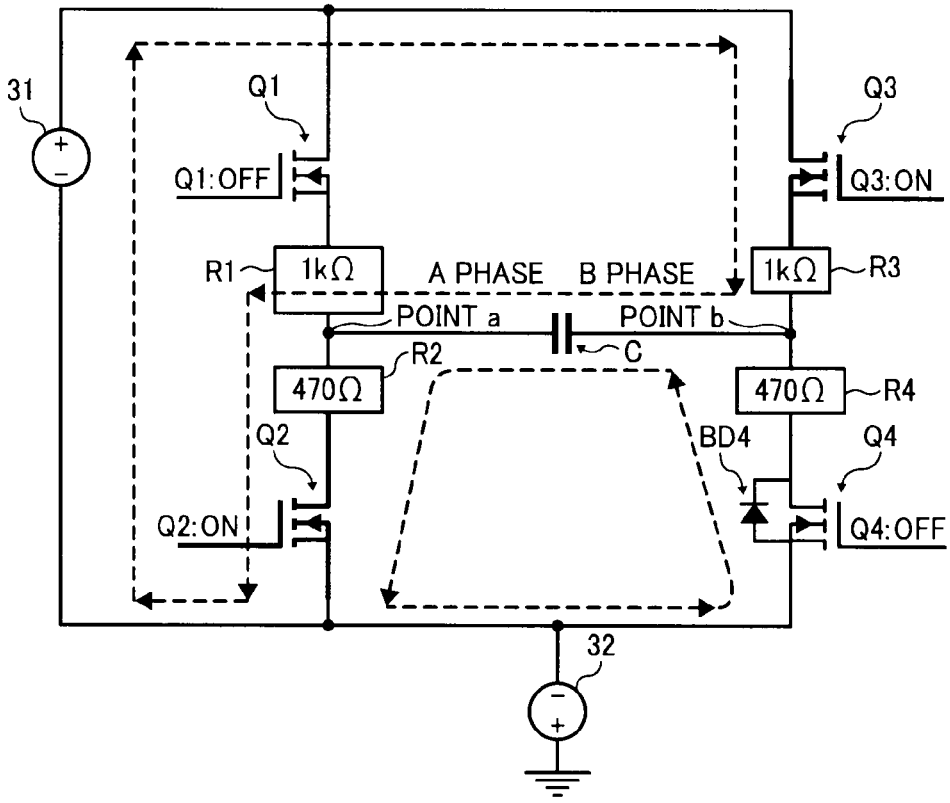
FIG. 26 illustrates circuitry that concerns the circuit operation in time t3 in the operational sequence shown in FIG. 22.
Figure 27:
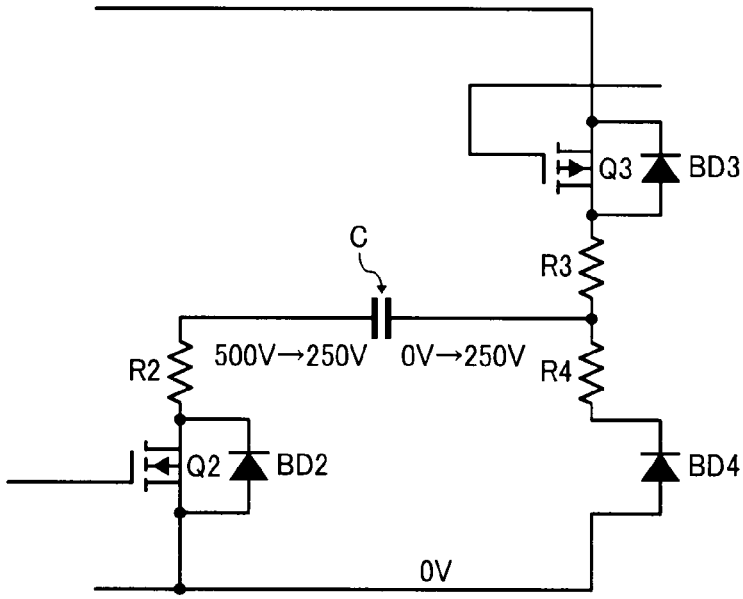
FIG. 27 illustrates a part of the circuitry concerning the circuit operation in time t3 in FIG. 22.

FIG. 26 illustrates circuitry that concerns the circuit operation in time t3 in the operational sequence shown in FIG. 22. FIG. 27 illustrates a part of the circuitry concerning the circuit operation in time t3 in FIG. 22.

Referring to FIG. 22, after all of the switching elements Q1, Q2, Q3, and Q4 are kept off for one microsecond (time t2), the switching elements Q2 and Q3 start on-operation operations in time t3. At this time, immediately when the switching element is turned on, a closed loop starting from the left end of the capacitor C to the current regulating resistor R2, the body diode BD4, and the right end of the capacitor C is formed, and electrical discharging is started.

Figure 28:
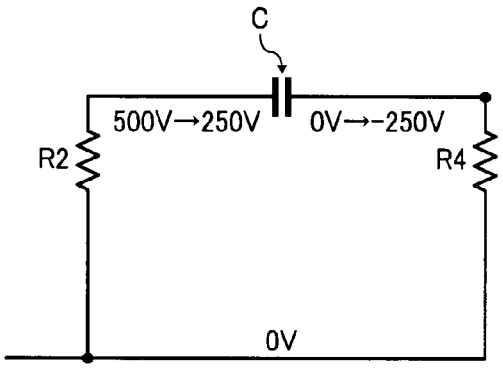
FIG. 28 illustrates mechanism of a drop in voltage at the right end of the capacitor at the moment the second switching element is turned on in the circuitry shown in FIG. 27.

Referring to FIG. 28, descriptions are given below of mechanism of a drop in the voltage on the right side of the capacitor C at the moment the switching element Q2 is turned on in FIG. 27.

More specifically, the left side of the capacitor C is charged to 500 V and its right side is charged to 0 V. When the switching element Q2 is turned on in this state, the voltage is divided by both the current regulating resistors R2 and R4. In the present configuration, because the resistances of the current regulating resistors R2 and R4 are identical (R2=R4), a voltage of 250 V is applied to each of the current regulating resistors R2 and R4. Although electrical potential of 250 V is generated at a point between the current regulating resistors R2 and R4 (a central point), the left end of the capacitor C electrically drops from 500 V to 250 V because the central point is clamped to 0 V. Additionally, the right end of the capacitor C electrically drops from 0 V to −250 V, and thus the voltage at the right end of the capacitor C drops to a minus voltage at that time. This decrease is hereinafter called "drop below zero". Subsequently, as the capacitor C discharges, the voltages at the left end and the right end thereof change from 250 V to 0 V and from −250 to 0 V, respectively, with a discharge time constant $\tau=C\times(R2+R4)$.

A waveform at the right end of the capacitor C at this time is described in further detail below with reference to FIGS. 29A and 29B.

Figure 29A:
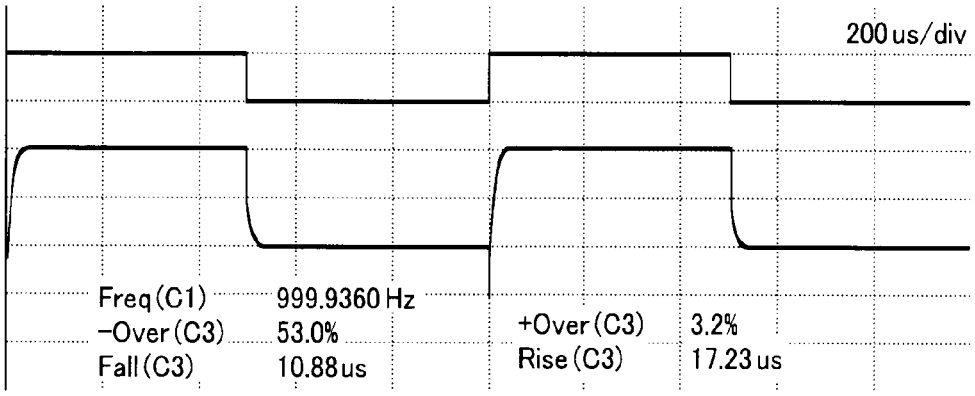
FIG. 29A is a graph that illustrates a waveform of the right end of the capacitor with a scale of 200 μs per division (200 μs/div)
Figure 29B:
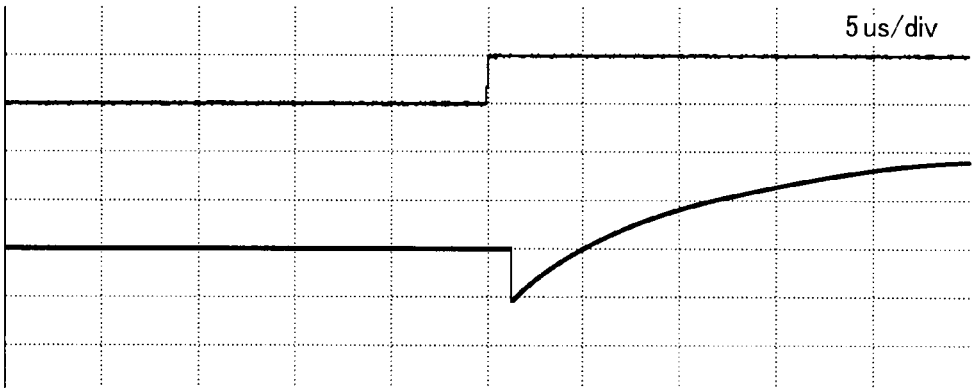
FIG. 29B is a graph that illustrates a boxed center portion in FIG. 29A with scale of 5 μs per division (5 μs/div), scaled up 40 times from FIG. 29A.

FIG. 29A is a graph that illustrates a waveform of the voltage at the right end of the capacitor C with a scale of 200 μs per division (200 μs/div), and FIG. 29B is an enlarged graph that illustrates a boxed center portion in FIG. 29A with scale of 5 μs per division (5 μs/div), scaled up 40 times from FIG. 29A. In FIGS. 29A and 29B, the upper lines represent waveform of a phase switching input signal whose low level (low value) is 0 V and high level (high value) is +5 V. When the phase switching input signal is low, the switching elements Q1 and Q 4 are off, and when the phase switching input signal is high, the switching elements Q1 and Q 4 are on. The lower lines in FIGS. 29A and 29B represent the voltage at the right end of the capacitor C.

The moment the phase-switching input signal switches from low to high and the voltage at the right end of the capacitor C is about to rise from 0 V to 500 V, the potential at the right end of the capacitor C temporarily drops from 0 V to −250 V (drop below zero). Subsequently, the potential at the right end of the capacitor C rises from −250 V to +500 V.

The above-described phenomenon, drop below zero, is radically different from such phenomena called overshoot and undershoot, which occur in typical logical circuit control. Overshoot and undershoot are phenomena of rising edge voltage and falling edge voltage exceeding a desired voltage after the voltage reaches a desired voltage, which are caused by an inductance component L or excessive response of the capacitor C present in the circuit. By contrast, the phenomenon called drop below zero herein occurs immediately before excessive response starts because the reference point of 0 V moves.

More specifically, at timing t1 in the operational sequence (timing chart) shown in FIG. 22, the reference point of 0 V is positioned at the right end of the capacitor C (although the current regulating resistor R4 is involved, the right end of the capacitor C becomes 0 V after the capacitor C is fully charged). By contrast, at timing t3 in FIG. 22, because a point between the current regulating resistors R2 and R4 becomes 0 V, the electrical potentials at the both ends of the capacitor C are shifted by an amount equals to $\frac{1}{2}\cdot V_{31}$, wherein $V_{31}$ represents the voltage of the first power source 31, which causes the drop below zero.

If the drop below zero occurs, it is necessary to rise a withstand voltage between the drain and the source of the power MOSFET or a withstand voltage of the electrical insulation layer of the capacitor C. Using power MOSFETs and capacitors capable of withstanding a higher voltage increase the cost. In particular, the increase in the withstand voltage between the drain and the source of the power MOSFET and the increase in the cost of the device thereby are not desirable. Additionally, charging of the capacitor C actually starts at −250 V although it is necessary to charge the capacitor C only from 0 V to 500 V. That is, loss time is present in charging the capacitor C, and accordingly the performance of the circuit is degraded. Moreover, because the right end of the capacitor C is charged from −250 V to 500 V due to the drop below zero, that is, the right end of the capacitor C at the start of charging has a lower electrical potential, the charge current increases compared with a case in which the capacitor C is charged from 0 V to 500 V. Consequently, power consumed in charging the capacitor C increases.

Simultaneously, the switching elements Q3 is turned on, and thus the charge current flows through the switching element Q3 and the current regulating resistor R3. In other words, charging and discharging are performed in the same period of time, which is inefficient. Additionally, because the current on which the discharge current and the charge current are overlapped flows through the switching element Q2, the switching element Q2 should be a MOSFET of a relatively large rated current. However, using such a MOSFET increases the cost.

Figure 30:
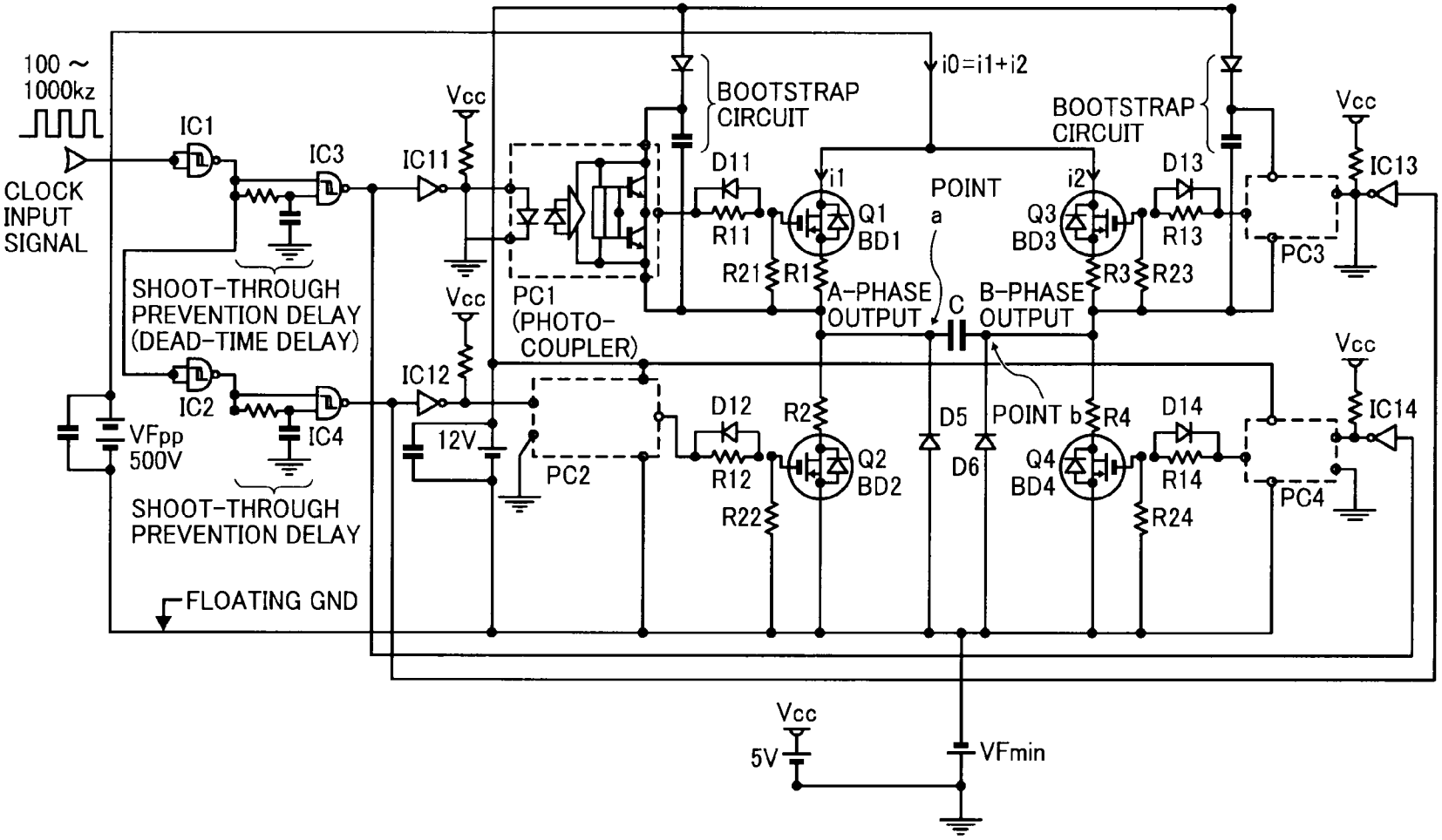
FIG. 30 illustrates circuitry in which diodes are inserted between the low-level side of the first power source and the respective ends of the capacitor.

In view of the foregoing, in the present embodiment, referring to FIG. 30, a diode D5 (first diode) is inserted between the low-level side of the first power source 31 and one end of the capacitor C and a diode D6 (second diode) is inserted between the low-level side of the first power source 31 and the other end of the capacitor C in order to eliminate the occurrence of the phenomenon called drop below zero, which occurs because the reference point of 0 V is shifted from the right end of the capacitor C to the point between the current regulating resistors R2 and R4 as described with reference to FIG. 24. With this configuration, simultaneously with the occurrence of drop below zero, electrical current flows from the anode to the cathode of the diode D5 or D6. Accordingly, the electrical potential at the right end of the capacitor C drops from 0 V only the voltage equals to a drop Vf in the forward direction of the diode D5 or D6 (generally 1 V to 2 V). Consequently, compared with a configuration in which the diodes D5 and D6 are not inserted between the low-level side of the first power source 31 and the respective ends of the capacitor C and accordingly the electrical potential at the right end of the capacitor C drops from 0 V to −250 V, the amount by which the voltage the right end of the capacitor C drops below 0 V can be reduced. Additionally, hopping of toner can become stable.

The diodes D5 and D6 can be such diodes that can withstand a maximum current in the forward direction obtained by dividing the voltage of the first power source 31 by the value of the current regulating resistor R2 ($V_{31}$/R2) and have a withstand voltage in the reverse direction from the cathode to the anode greater than the voltage of the first power source 31. Using fast recovery diodes (FRDs) as the diodes D5 and D6 is more effective because they can switch promptly from the reverse direction to the forward direction.

It is to be noted that power MOSFETs without body diodes may be implemented as the switching elements Q2 and Q4. That is, a configuration in which the closed loop from the left end of the capacitor C to the current regulating resistor R2, the switching element Q2, the body diode BD4, the current regulating resistor R4, and the right end of the capacitor C is not formed at the moment the switching element Q2 is turned on may be adopted. However, such a configuration has a drawback in that, because the circuit components are inevitably connected via a slight stray capacitance due to the necessity in circuitry design, the amount of the drop below zero varies depending on the value of the stray capacitance, and thus determination of optimum values are difficult.

Figure 31:
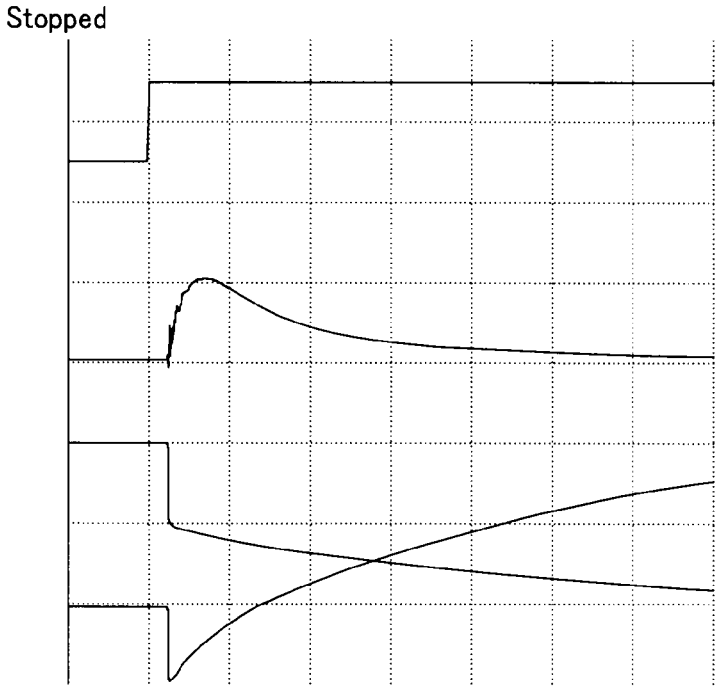
FIG. 31 is a graph that illustrates a waveform when a circuit in which the diodes are not inserted between the low-level side of the first power source and the respective ends of the capacitor is used.

FIG. 31 is a graph that illustrates waveforms when a comparative circuit in which the diodes D5 and D6 are not inserted between the low-level side of the first power source 31 and the respective ends of the capacitor C is used. In FIG. 31, the first, second, third, and fourth lines from the top represent a waveform of the phase-switching input signal, that of the current flowing out from the first power source 31, that of the voltage at the left end of the capacitor C, and that of the right end of the capacitor C, respectively.

In FIG. 31, when the phase-switching input signal is switched, the voltage at the right end of the capacitor C drops from 0 V to −250 V, that is, a significant drop below zero occurs.

Figure 32:
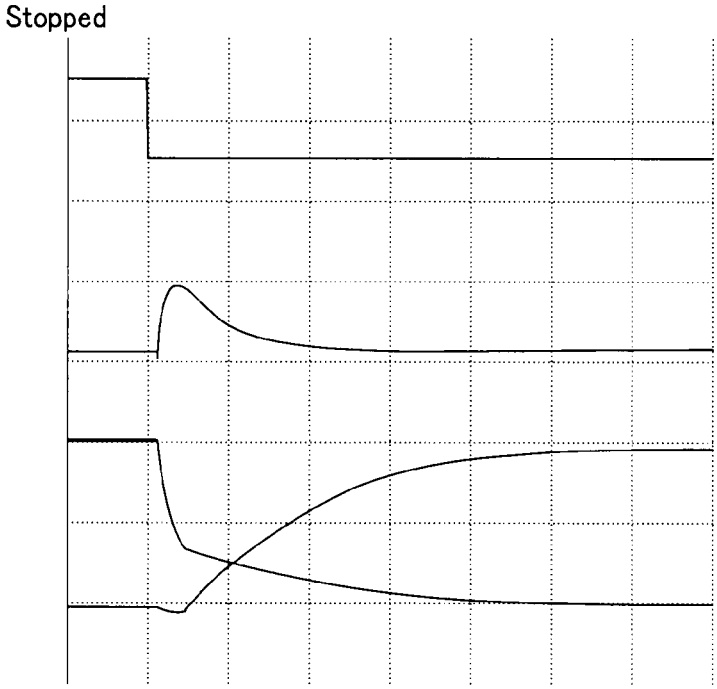
FIG. 32 is a graph that illustrates a waveform when a circuit in which the diodes are not inserted between the low-level side of the first power source and the respective ends of the capacitor is used.

By contrast, FIG. 32 is a graph that illustrates a waveform when a circuit in which the diodes D5 and D6 are inserted between the low-level side of the first power source 31 and the respective ends of the capacitor C is used. In FIG. 32, the first, second, third, and fourth lines from the top represent a waveform of the phase-switching input signal, that of the current flowing out from the first power source 31, that of the voltage at the left end of the capacitor C, and that of the right end of the capacitor C, respectively.

Referring to FIG. 32, although the voltage at the right end of the capacitor C drops momentarily below 0 V when the phase-switching input signal is switched, the drop can be restricted within several volts due to the above-described effects attained by inserting the diode D5 or D6 between the low-level side of the first power source 31 and the respective ends of the capacitor C. Additionally, charging is started from 0 V to 500 V. Thus, start-up of the waveform shown in FIG. 32 can be prompt compared with the waveform shown in FIG. 31, in which charging is started from −250 V to 500 V.

Figure 33:
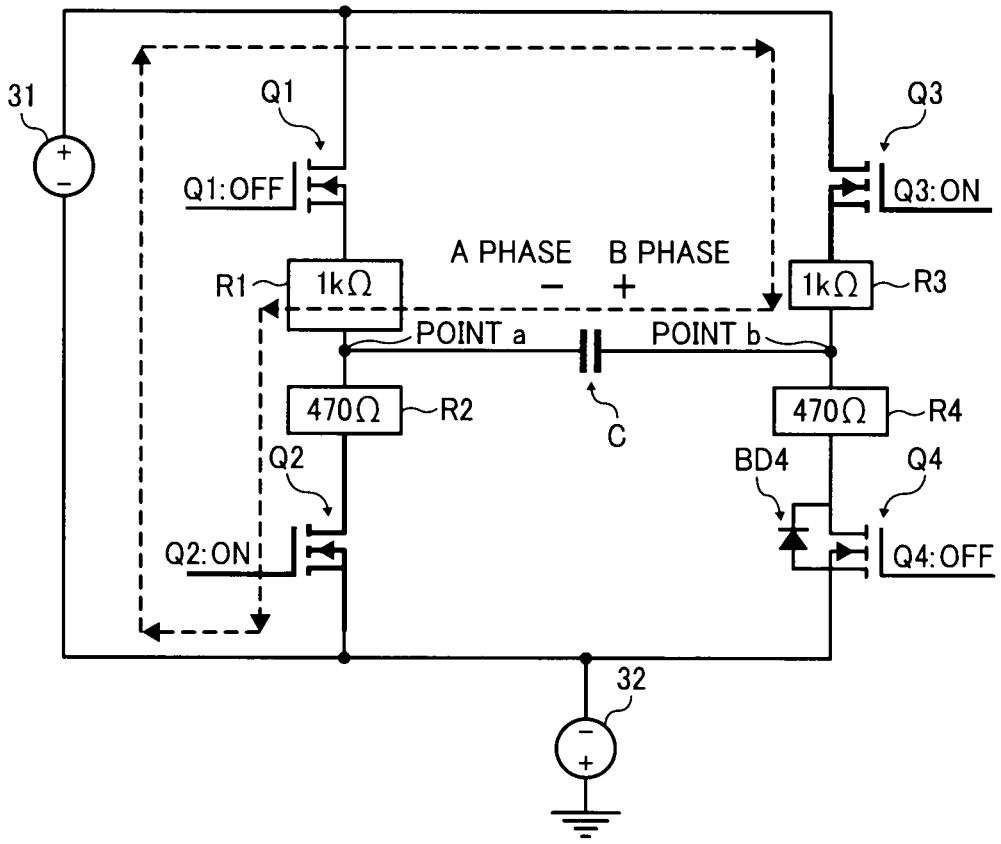
FIG. 33 illustrates circuitry that concerns the circuit operation in time t4 in the operational sequence shown in FIG. 22.

FIG. 33 illustrates circuitry that concerns the circuit operation in time t4 in the timing chart shown in FIG. 22.

When a period calculated using the charging time constant of 1.47 K×C has fully elapsed after the switching elements Q2 and Q3 are turned on, the electrical potential at the right end of the capacitor C increases from −250 V to 500 V with the voltage of the first power source 31. Thus, the capacitor C is fully charged, and the charge current becomes zero.

Figure 34:
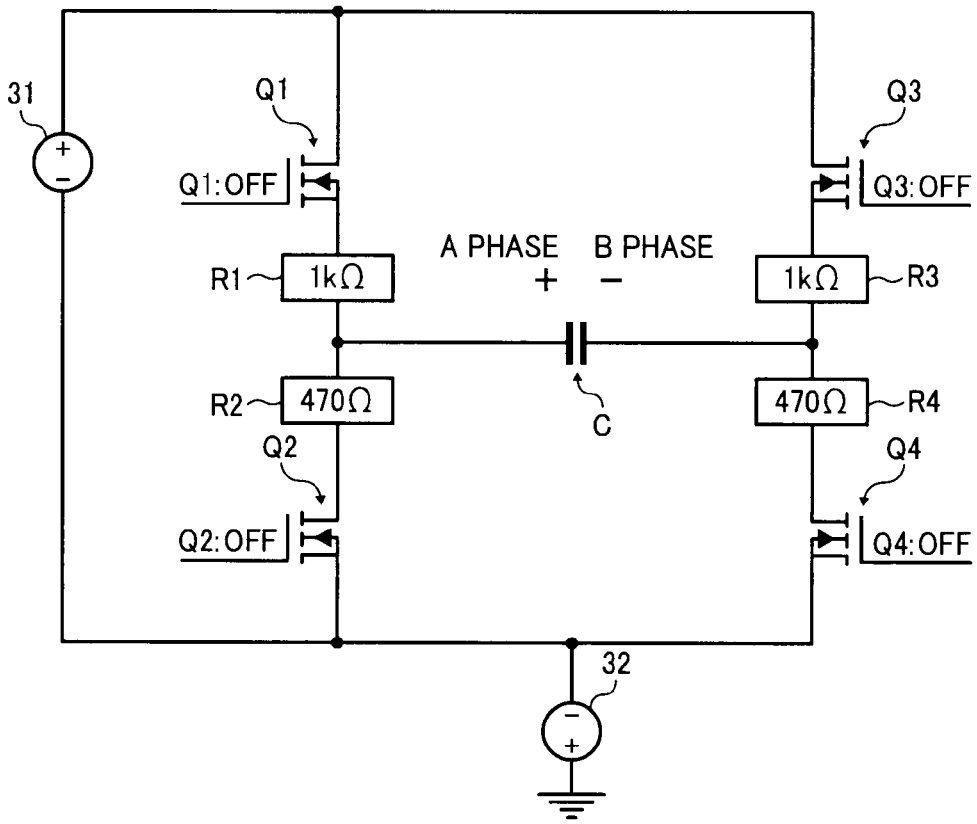
FIG. 34 illustrates circuitry that concerns the circuit operation in time t5 in the operational sequence shown in FIG. 22.

FIG. 34 illustrates circuitry that concerns the circuit operation in time t5 in the timing chart shown in FIG. 22.

In a configuration in which the switching elements Q3 and Q4 are designed to switch simultaneously from an on-state to a off-state and from a off-state to an on-state, respectively, if the switching element Q4 is turned on although the switching element Q3 is still on due to fluctuations in the operational timing, it is possible that electrical current (i.e., a shoot-through current) flows from the switching element Q3 to the switching element Q4, which is not desirable.

To prevent such shoot-through current, the operational sequence includes a period during which all of the switching elements Q1, Q2, Q3 (time t5 in FIG. 22), and Q4 are off, thereby preventing or reducing the occurrence of shoot-through current. In the example shown in FIG. 22, the time t5 is 1 μs. Additionally, during the time t5, for example, 1 μs, during which all of the switching elements Q1, Q2, Q3, and Q4 are off, the charge is kept in the capacitor C because its electrical discharge route is not present.

Figure 35:
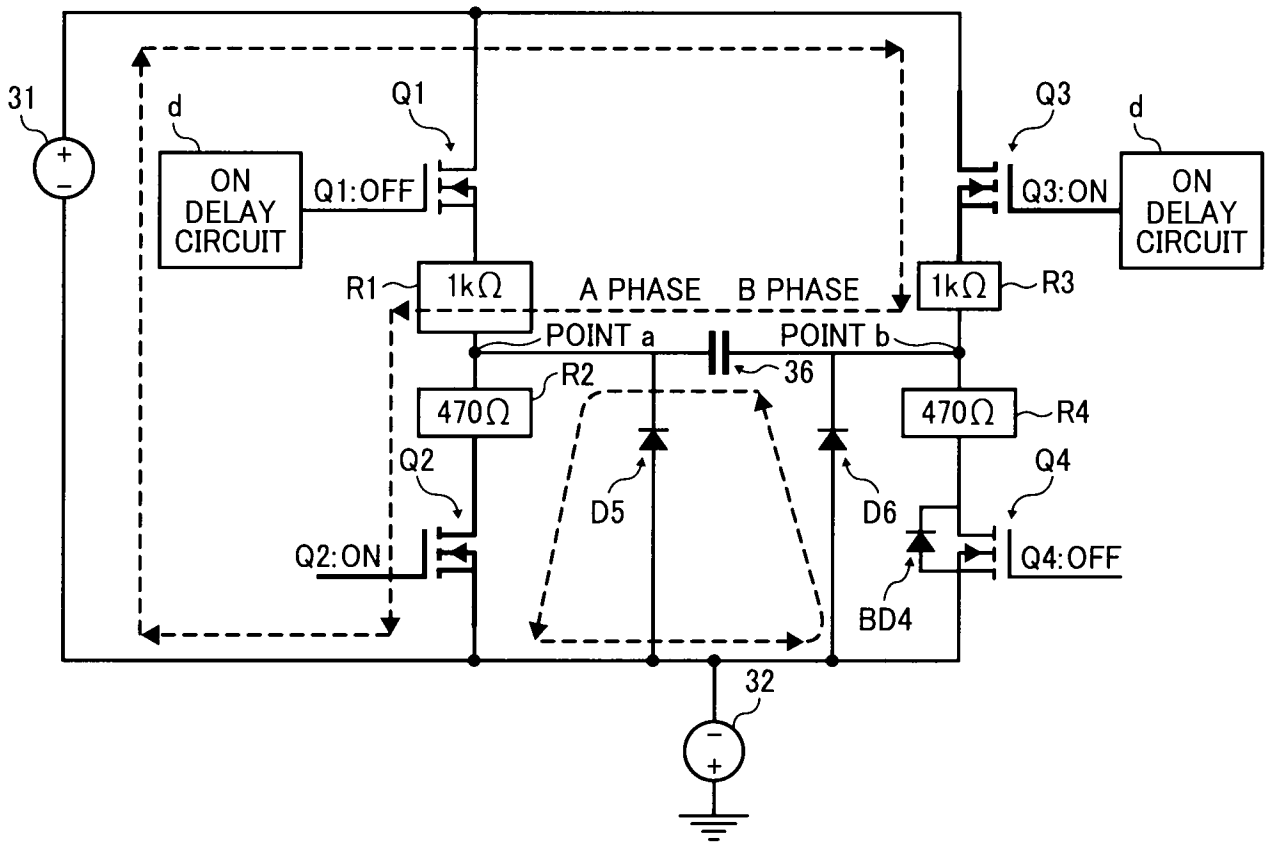
FIG. 35 illustrates circuitry including delay circuits and diodes inserted between the low-level side of the first power source and the respective ends of the capacitor.
Figure 37:
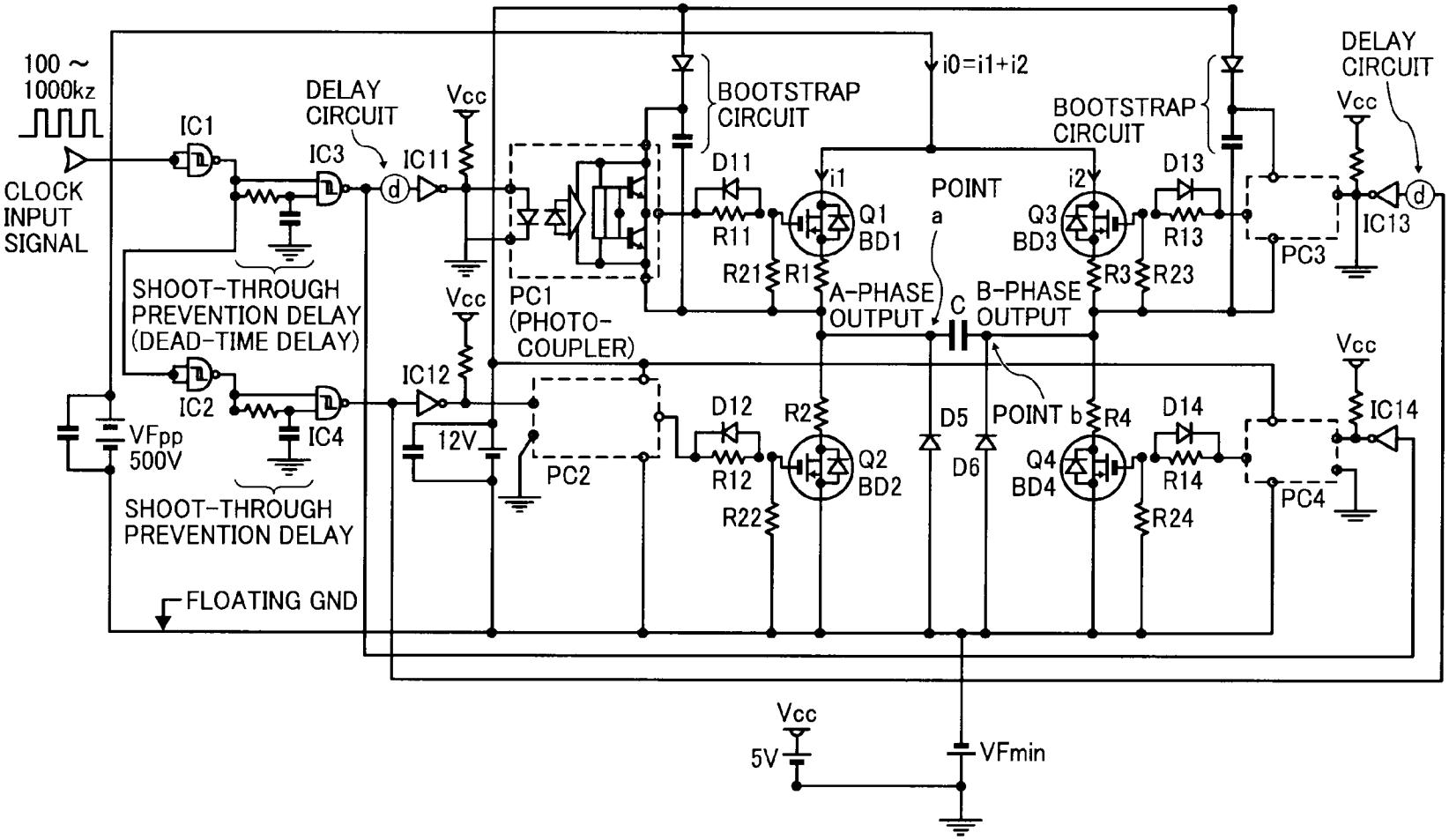
FIG. 37 illustrates circuitry including delay circuits and diodes inserted between the low-level side of the first power source and the respective ends of the capacitor.

In the present embodiment, as shown in FIGS. 35 and 37, in the circuitry in which the diodes D5 and D6 are inserted between the low-level side of the first power source 31 and the respective ends of the capacitor C, a delay circuit d is provided in the gate circuit of each of the power MOSFETs serving as the switching elements Q1 and Q3. With this configuration, the timing at which the switching element Q1 is turned on is delayed from the timing at which the switching element Q4 is turned on, or the timing at which the switching element Q3 is turned on is delayed from the timing at which the switching element Q2 is turned on.

Figure 36:
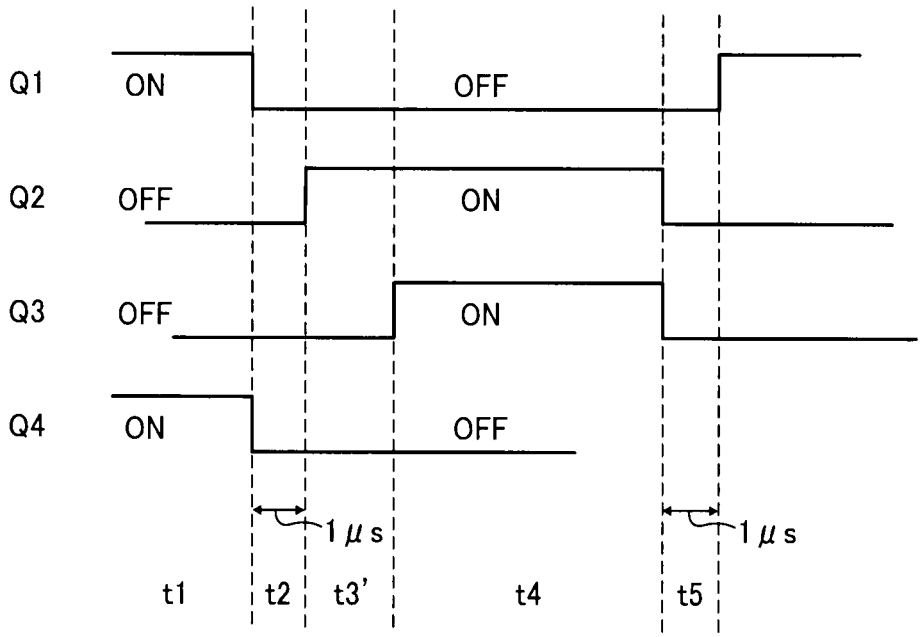
FIG. 36 illustrates on/off operational sequence of the switching elements when the delay circuits are provided.
Figure 39:
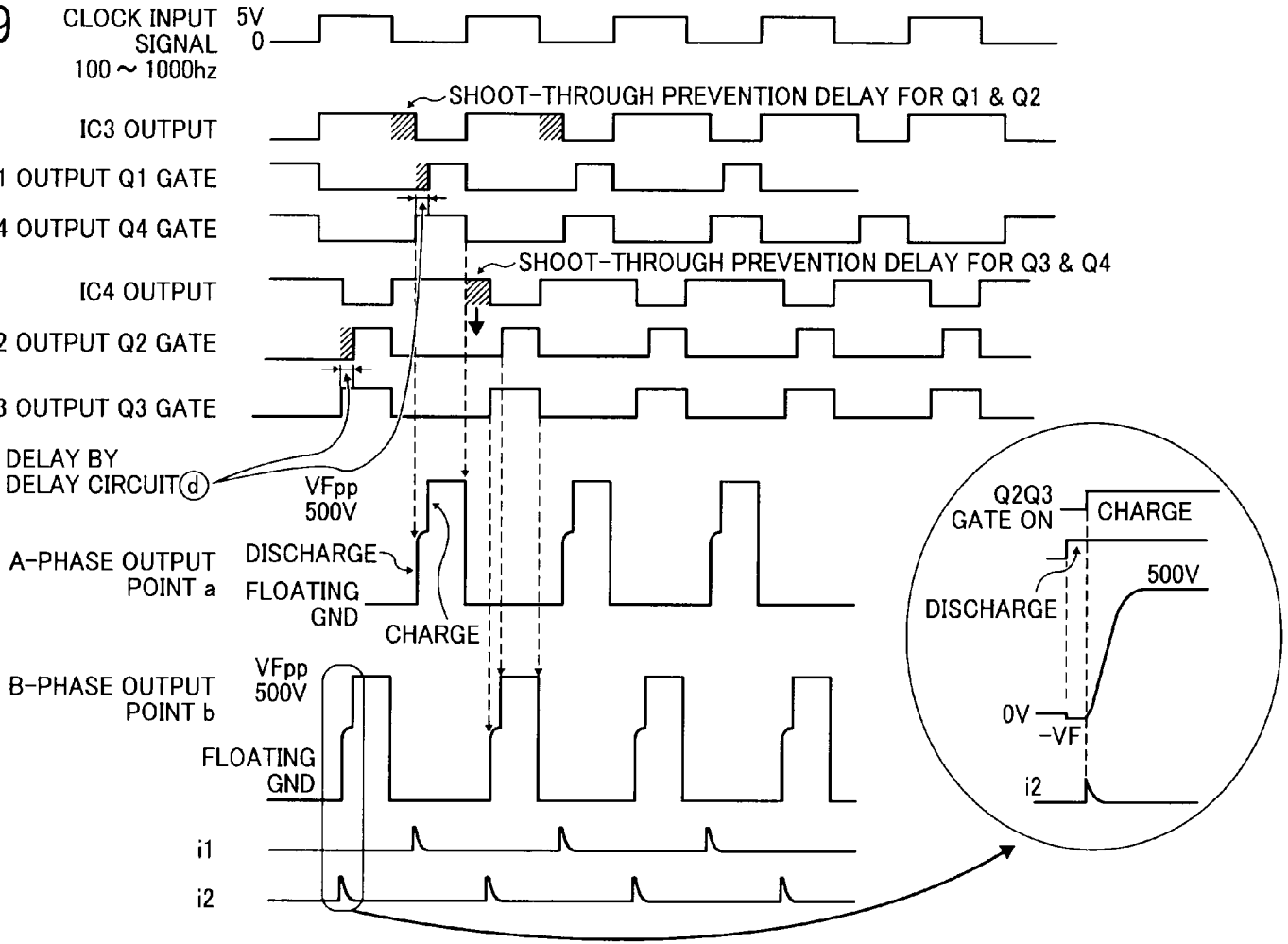
FIG. 39 illustrates on/off operational sequence of the first, second, third, and fourth switching elements when the delay circuits are provided.

FIGS. 36 and 39 are timing charts that illustrate on/off operational sequence of the switching elements Q1, Q2, Q3, and Q4 when the delay circuits d are provided. In time t3' in the timing chart of FIG. 36, the timing of turning on the switching element Q3 is delayed from the timing of turning on the switching element Q2. With such control, in the circuitry shown in FIG. 35, discharging and charging the capacitor C can be performed separately. That is, charging of the capacitor C can be started after discharging thereof ends.

In the circuitry according to the present embodiment, when it is assumed that the current regulating resistors R2 and R4 have an identical resistance of 470Ω (R2=R4=470Ω), the capacitor C is 100 nF, and the resistance of the diodes D5 and D6 is 0Ω, the discharge time constant is 10 nF×470 Ω=4.7 μs. When it is assumed that the discharge time constant is about 5 μs for ease of understanding, the discharge of electricity charged in the capacitor C is 63% when the time constant is multiplied by one (5 μs), 87% when the time constant is multiplied by two (10 μs), and 95% when the time constant is multiplied by three (15 μs). Therefore, in the present embodiment, the charging the capacitor C can be started after the discharge thereof is substantially completed by delaying the timing of turning on the switching element Q1 or Q3 from the timing of turning on the switching element Q2 or Q 4 at least for a period twice or three times the discharge time constant of the capacitor C.

Therefore, power consumption necessary for charging the capacitor C can be reduced, thus attaining energy saving. Additionally, performing discharging and charging the capacitor C separately can prevent the current on which the discharge current and the charge current are overlapped from flowing in the switching element Q2. Accordingly, it is not necessary using a MOSFET of a relatively large rated current as the switching element Q2, and thus an increase in the cost can be restricted.

As an experiment, when the switching elements Q1, Q2, Q3, and Q4 were switched on and off according to the operational sequence shown in FIG. 36 using the circuitry shown in FIG. 35, the power consumption was reduced by 8.68 W from 38.66 W to 29.86 W.

It is to be noted that, although the time required for charging the capacitor C is increased by a period corresponding to the above-described delay, this increase in time is within a range that does not affect the performance for causing toner to hop along the toner-carrying roller 101.

As described above, the development device 1 according to the present embodiment includes the toner-carrying roller 101 that serves as the toner carrier and includes multiple electrodes, the toner supply roller 18 serving as the toner supplier to supply the toner onto the surface of the toner-carrying roller 101, the electrical field generator to generate electrical fields on the surface of the toner-carrying tonner for causing the toner to hop thereon. The electrical field generator includes the A-phase pulse generation circuit 33 to generate the normal-phase pulse voltage, the B-phase pulse generation circuit 34 to generate the reversed-phase pulse voltage, and the first and second power sources 31 and 32. The first power source 31 is a DC power source that supplies a bias to set the peak value of the pulse voltages generated by the A-phase pulse generation circuit 33 and the B-phase pulse generation circuit 34 and is electrically floating from the ground voltage. The second power source 32 is a DC power source having a polarity identical to that of the charge of the toner and is provided between the lower potential side of the first power source 31 and the ground voltage. The output from the second power source 32 is variable.

The A-phase pulse generation circuit 33 includes the switching elements Q1 and Q2, serving as the first and second switching elements, provided between the terminals of the first power source 31, and the current regulating resistors R1 and R2 serially connected between the switching elements Q1 and Q2. The switching element Q1 is on the higher potential side of the first power source 31, and the switching element Q2 is on the lower potential side of the first power source 31. The B-phase pulse generation circuit 34 is connected in parallel to the A-phase pulse generation circuit 33. The B-phase pulse generation circuit 34 includes the switching elements Q3 and Q4, serving as the third and fourth switching elements, provided between the terminals of the first power source 31, and the current regulating resistors R3 and R4 serially connected between the switching elements Q3 and Q4. The switching element Q3 is on the higher potential side of the first power source 31, and the switching element Q4 is on the lower potential side of the first power source 31.

In the development device 1 in which the toner is carried on the surface of the toner-carrying roller 101 and conveyed to the development area so as to develop the latent image formed on the photoconductor 49, one of the first and second groups of electrodes of the toner-carrying roller 101, namely, the A-phase electrodes 111A and the B-phase electrodes 111B, is connected between the switching elements Q1 and Q2 of the A-phase pulse generation circuit 33, and the other group of electrodes of the toner carrying roller 101 is connected between the switching elements Q3 and Q4 of the B-phase pulse generation circuit 34, and thus the bridge configuration is formed. In such a configuration, the switching elements Q1 and Q4 are turned on to apply the positive-phase (normal-phase) pulse voltage to the electrodes, and the switching elements Q2 and Q3 are turned on to apply the negative-phase (reversed-phase) pulse voltage to the electrodes.

In the development device 1 having such a configuration, when both the switching elements Q1 and Q4 are turned on, the switching element Q1 is turned on after a predetermined delay time from when the switching element Q4 is turned on. Similarly, when both the switching elements Q2 and Q3 are turned on, the switching element Q3 is turned on after a predetermined delay time from when the switching element Q2 is turned on. Such control can prevent charging operation by the switching elements Q1 and Q3 on the higher potential side from overlapping the discharge operation that is performed when the switching elements Q2 and Q4 on the lower potential side are in the on-state. For example, charging the capacitor C formed with the first and second groups of electrodes can be started after discharging thereof ends. Therefore, power consumption necessary for charging the capacitor C can be reduced, thus attaining energy saving. Additionally, because this control can prevent the electrical current on which the discharge current and the charge current are overlapped from flowing in the switching elements Q2 and Q4 on the lower potential side, it is not necessary using switching elements having higher withstand voltage as the switching elements Q2 and Q4 on the lower potential side. Thus, the cost does not increase.

Additionally, when the output level of the first power source (31A shown in FIG. 10) is variable, the peak value of the pulse voltage (toner cloud pulse) can be controlled by adjusting the output level of the bias from the first power source. Accordingly, the peak value of the pulse voltage and the DC bias value can be adjusted separately with a relatively simple circuitry.

Additionally, according to the above-described embodiments, by varying the output level of the second power source 32 according to the image density signals output from the image density detector 65 provided in the image forming apparatus 200, the image density regulation circuit 66, and the like, the level of the development bias relative to the electrical potential of the latent image on the photoconductor 49 can be adjusted according to the image density signal when the density of the image formed on the photoconductor 49 fluctuates. Accordingly, image density can be kept constant.

Further, in the present embodiment, the delay circuits d are provided for the switching elements Q1 and Q3, respectively, to delay the timing of turning on the switching element Q1 and that of the switching element Q3. The delay circuit d delays the timing at which the switching element Q1 or Q3 is turned on for a period twice or three times the discharge time constant of the capacitor C, as the above-described predetermined delay time, from the timing at which the switching element Q2 or Q 4 is turned on. Thus, the charging the capacitor C can be started after the discharge thereof is substantially completed.

Further, according to the above-described embodiments, the development device 1 and at least one of the photoconductor 49, the charging device 50, and the cleaning unit 45 are housed in a common unit casing and thus united as a process cartridge that is removably installable in the image forming apparatus 200.

Additionally, by incorporating the above-described development device 1 into the image forming apparatus that forms images by supplying developer to the latent image formed on the photoconductor 49 to develop it and transferring the developed image onto the recording medium, the various effects described above and reliable image formation can be attained.

Further, by using the above-described process cartridge, the various effects described above can be attained. Multicolor image forming apparatuses include multiple process cartridges each having the configuration described above.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device to develop an electrostatic latent image formed on a latent image carrier, the development device comprising:

a developer container for containing toner;

a toner carrier disposed facing the latent image carrier, the toner carrier including a first group of electrodes and a second group of electrodes that together form a capacitor;

a toner supplier disposed in the developer container, to supply the toner to a surface of the toner carrier;

an electrical field generator to generate an electrical field for causing the toner to hop along the surface of the toner carrier, the electrical field generator including:

a positive-phase pulse voltage generation circuit to generate a positive-phase pulse voltage applied to the first group of electrodes, a negative-phase pulse voltage generation circuit connected in parallel to the positive-phase pulse voltage generation circuit, to generate a negative-phase pulse voltage applied to the second group of electrodes, a first power source that is a DC power source floating from a ground voltage, the first power source supplying a bias to the positive-phase pulse voltage generation circuit and the negative-phase pulse voltage generation circuit to set a peak value of the positive-phase pulse voltage and the negative-phase pulse voltage, a second power source that is a DC power source connected between a lower potential side of the first power source and the ground voltage, to output a variable level of voltage, the voltage having a polarity identical to a polarity of a charge of the toner, a first diode having an anode connected to the lower potential side of the first power source and a cathode connected to an output terminal of the positive-phase pulse voltage generation circuit, and a second diode having an anode connected to the lower potential side of the first power source and a cathode connected to an output terminal of the negative-phase pulse voltage generation circuit, the positive-phase pulse voltage generation circuit including a first switching element, a second switching element, and a first current regulating resistor serially connected between terminals of the first power source, and the negative-phase pulse voltage generation circuit including a third switching element, a fourth switching element, and a second current regulating resistor serially connected between the terminals of the first power source, the first group of electrodes connected between the first and second switching elements of the positive-phase pulse voltage generation circuit, and the second group of electrodes connected between the third and fourth switching elements of the negative-phase pulse voltage generation circuit, thus forming a bridge configuration, wherein, when the positive-phase pulse voltage is applied to the first group of electrodes, the first and fourth switching elements are turned on, and, when the negative-phase pulse voltage is applied to the second group of electrodes, the second and third switching elements are turned on.

2. The development device according to claim 1, wherein the positive-phase pulse voltage generation circuit further comprises a first delay circuit to delay a timing at which the first switching element is turned on for a predetermined delay time from a timing at which the fourth switching element is turned on, and the negative-phase pulse voltage generation circuit further comprises a second delay circuit to delay a timing at which the third switching element is turned on for the predetermined delay time from a timing at which the second switching element is turned on.

3. The development device according to claim 2, wherein the predetermined delay time is at least twice as long as a discharge time constant of the capacitor including the first and second groups of electrodes.

4. The development device according to claim 3, wherein the predetermined delay time is at least three times as long as the discharge time constant of the capacitor including the first and second groups of electrodes.

5. The development device according to claim 1, wherein a level of the bias output from the first power source is variable to adjust the peak value of the positive-phase pulse voltage and the negative-phase pulse voltage.

6. The development device according to claim 1, wherein the level of the voltage output from the second power source is varied in accordance with an image density signal output from an image density detector that detects a density of an image formed on the latent image carrier.

7. A process cartridge removably installable in an image forming apparatus, comprising the development device according to claim 1, wherein the development device and at least one of a latent image carrier, a charge device, and a cleaning device are housed in a common casing.

8. A development device to develop an electrostatic latent image formed on a latent image carrier, the development device comprising:

a developer container for containing toner;

a toner carrier disposed facing the latent image carrier, the toner carrier including a first group of electrodes and a second group of electrodes, together forming a capacitor;

a toner supplier disposed in the developer container, to supply the toner to a surface of the toner carrier;

an electrical field generator to generate an electrical field for causing the toner to hop along the surface of the toner carrier, the electrical field generator including:

a positive-phase pulse voltage generation circuit to generate a positive-phase pulse voltage applied to the first group of electrodes, a negative-phase pulse voltage generation circuit connected in parallel to the positive-phase pulse voltage generation circuit, to generate a negative-phase pulse voltage applied to the second group of electrodes, a first power source that is a DC power source floating from a ground voltage, the first power source supplying a bias to the positive-phase pulse voltage generation circuit and the negative-phase pulse voltage generation circuit to set a peak value of the positive-phase pulse voltage and the negative-phase pulse voltage, and a second power source that is a DC power source connected between a lower potential side of the first power source and the ground voltage, to output a variable level of voltage, the voltage having a polarity identical to a polarity of a charge of the toner, the positive-phase pulse voltage generation circuit including first and second switching elements connected between terminals of the first power source, the first switching element disposed on a higher potential side of the first power source, the second switching element disposed on the lower potential side of the first power source, a first current regulating resistor serially connected between the first and second switching elements, and a first delay circuit to delay a timing at which the first switching element is turned on, the negative-phase pulse voltage generation circuit including third and fourth switching elements connected between the terminals of the first power source, the third switching element disposed on the higher potential side of the first power source, the fourth switching element disposed on the lower potential side of the first power source, a second current regulating resistor serially connected between the third and fourth switching elements, and a second delay circuit to delay a timing at which the third switching element is turned on, the first group of electrodes connected between the first and second switching elements of the positive-phase pulse voltage generation circuit, and the second group of electrodes connected between the third and fourth switching elements of the negative-phase pulse voltage generation circuit, thus forming a bridge configuration, wherein, when the positive-phase pulse voltage is applied to the first group of electrodes, the first and fourth switching elements are turned on, and the first delay circuit delays the timing at which the first switching element is turned on for a predetermined delay time from a timing at which the fourth switching element is turned on, and when the negative-phase pulse voltage is applied to the second group of electrodes, the second and third switching elements are turned on, and the second delay circuit delays the timing at which the third switching element is turned on for the predetermined delay time from a timing at which the second switching element is turned on.

9. The development device according to claim 8, wherein the predetermined delay time is at least twice as long as a discharge time constant of the capacitor including the first and second groups of electrodes.

10. The development device according to claim 9, wherein the predetermined delay time is at least three times as long as the discharge time constant of the capacitor including the first and second groups of electrodes.

11. The development device according to claim 8, wherein a level of the bias output from the first power source is variable to adjust the peak value of the positive-phase pulse voltage and the negative-phase pulse voltage.

12. The development device according to claim 8, wherein the level of the voltage output from the second power source is varied in accordance with an image density signal output from an image density detector that detects a density of an image formed on the latent image carrier.

13. A process cartridge removably installable in an image forming apparatus, comprising the development device according to claim 8, wherein the development device and at least one of a latent image carrier, a charge device, and a cleaning device are housed in a common casing.

14. An image forming apparatus comprising:

a latent image carrier on which a latent image is formed; and a development device to develop the electrostatic latent image formed on the latent image carrier, the development device comprising:

a developer container for containing toner;

a toner carrier disposed facing the latent image carrier, the toner carrier including a first group of electrodes and a second group of electrodes that together form a capacitor;

a toner supplier disposed in the developer container, to supply the toner to a surface of the toner carrier;

an electrical field generator to generate an electrical field for causing the toner to hop along the surface of the toner carrier, the electrical field generator including:

a positive-phase pulse voltage generation circuit to generate a positive-phase pulse voltage applied to the first group of electrodes, a negative-phase pulse voltage generation circuit connected in parallel to the positive-phase pulse voltage generation circuit, to generate a negative-phase pulse voltage applied to the second group of electrodes, a first power source that is a DC power source floating from a ground voltage, the first power source supplying a bias to the positive-phase pulse voltage generation circuit and the negative-phase pulse voltage generation circuit to set a peak value of the positive-phase pulse voltage and the negative-phase pulse voltage, and a second power source that is a DC power source connected between a lower potential side of the first power source and the ground voltage, to output a variable level of voltage, the voltage having a polarity identical to a polarity of a charge of the toner, the positive-phase pulse voltage generation circuit including first and second switching elements connected between terminals of the first power source, the first switching element disposed on a higher potential side of the first power source, the second switching element disposed on the lower potential side of the first power source, a first current regulating resistor serially connected between the first and second switching elements, and a first delay circuit to delay a timing at which the first switching element is turned on, the negative-phase pulse voltage generation circuit including third and fourth switching elements connected between the terminals of the first power source, the third switching element disposed on the higher potential side of the first power source, the fourth switching element disposed on the lower potential side of the first power source, a second current regulating resistor serially connected between the third and fourth switching elements, and a second delay circuit to delay a timing at which the third switching element is turned on, the first group of electrodes connected between the first and second switching elements of the positive-phase pulse voltage generation circuit, and the second group of electrodes connected between the third and fourth switching elements of the negative-phase pulse voltage generation circuit, thus forming a bridge configuration, wherein, when the positive-phase pulse voltage is applied to the first group of electrodes, the first and fourth switching elements are turned on, and the first delay circuit delays the timing at which the first switching element is turned on for a predetermined delay time from a timing at which the fourth switching element is turned on, and when the negative-phase pulse voltage is applied to the second group of electrodes, the second and third switching elements are turned on, and the second delay circuit delays the timing at which the third switching element is turned on for the predetermined delay time from a timing at which the second switching element is turned on.

15. The image forming apparatus according to claim 14, wherein the predetermined delay time is at least twice as long as a discharge time constant of the capacitor including the first and second groups of electrodes.

16. The image forming apparatus according to claim 15, wherein the predetermined delay time is at least three times as long as the discharge time constant of the capacitor including the first and second groups of electrodes.

17. The image forming apparatus according to claim 14, wherein a level of the bias output from the first power source is variable to adjust the peak value of the positive-phase pulse voltage and the negative-phase pulse voltage.

18. The image forming apparatus according to claim 14, further comprising an image density detector to detect a density of an image formed on the latent image carrier, wherein the level of the voltage output from the second power source is varied in accordance with an image density signal output from the image density detector.

19. The image forming apparatus according to claim 14, wherein the electrical field generator further comprises:

a first diode having an anode connected to the lower potential side of the first power source and a cathode connected to an output terminal of the positive-phase pulse voltage generation circuit; and a second diode having an anode connected to the lower potential side of the first power source and a cathode connected to an output terminal of the negative-phase pulse voltage generation circuit.

* * * * *